US012768021B2

(12) United States Patent
Kawano

(10) Patent No.: US 12,768,021 B2
(45) Date of Patent: Oct. 20, 2026

(54) STEEL MATERIAL AND MOLD

(71) Applicant: DAIDO STEEL CO., LTD., Nagoya (JP)

(72) Inventor: Masamichi Kawano, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 430 days.

(21) Appl. No.: 18/380,837

(22) Filed: Oct. 17, 2023

(65) Prior Publication Data

US 2024/0133005 A1 Apr. 25, 2024
US 2024/0229202 A9 Jul. 11, 2024

(30) Foreign Application Priority Data

Oct. 19, 2022 (JP) ..... 2022-167688

(51) Int. Cl.

| | |
|---|---|
| ***C22C 38/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |

(52) U.S. Cl.
CPC ..... *C22C 38/46* (2013.01); *C22C 38/001* (2013.01); *C22C 38/02* (2013.01); *C22C 38/04* (2013.01); *C22C 38/06* (2013.01); *C22C 38/42* (2013.01); *C22C 38/44* (2013.01)

(58) Field of Classification Search
None
See application file for complete search history.

(56) References Cited

U.S. PATENT DOCUMENTS

2008/0302501 A1 12/2008 Binot et al.
2022/0162732 A1 5/2022 Kawano

FOREIGN PATENT DOCUMENTS

| | | | | | |
|---|---|---|---|---|---|
| CN | 1445379 | A | | 10/2003 | |
| CN | 101316943 | A | | 12/2008 | |
| CN | 101792886 | A | | 8/2010 | |
| CN | 104894479 | A | | 9/2015 | |
| CN | 114540702 | A | | 5/2022 | |
| CN | 114875334 | A | * | 8/2022 | ..... C22C 38/44 |
| EP | 2 218 802 | A1 | | 8/2010 | |
| EP | 2270246 | A1 | | 1/2011 | |

(Continued)

OTHER PUBLICATIONS

Korean Office Action dated May 17, 2025 in Korean Patent Application No. 10-2023-0138913 with machine English translation.

(Continued)

*Primary Examiner* — Jenny R Wu
(74) *Attorney, Agent, or Firm* — McGinn IP Law Group, PLLC

(57) ABSTRACT

The present invention relates to a steel material containing: 0.19 mass %≤C≤0.31 mass %; 0.010 mass %≤V≤0.180 mass %; Mn≤1.50 mass %; 5.60 mass %≤Cr≤6.60 mass %; Cu+Ni≤0.84 mass %; 0.40 mass %≤Si≤1.40 mass %; 0.60 mass %≤Mo≤2.00 mass %; 0.001 mass %≤Al≤0.080 mass %; and 0.003 mass %≤N≤0.040 mass %, with a balance being Fe and unavoidable impurities, in which the contents of Mn and Cr satisfy Mn/Cr>0.150.

16 Claims, 5 Drawing Sheets

(56) References Cited

FOREIGN PATENT DOCUMENTS

| | | | | |
|---|---|---|---|---|
| EP | 2 915 895 | A2 | | 9/2015 |
| JP | H02-254135 | A | | 10/1990 |
| JP | 2003-226939 | A | | 8/2003 |
| JP | 2008121032 | A | * | 5/2008 |
| JP | 2010-024510 | A | | 2/2010 |
| JP | 2011-001572 | A | | 1/2011 |
| KR | 10-2015-0066623 | A | | 6/2015 |
| UA | 74757 | C2 | | 1/2006 |

OTHER PUBLICATIONS

Extended European Search Report, dated Feb. 22, 2024 in European Application No. 23204046.9 (in English).
Chinese Office Action dated Apr. 17, 2026 in Chinese Patent Application No. 202311327376.9 with machine English translation.
Korean Office Action dated Dec. 24, 2025 in Korean Patent Application No. 10-2023-0138913 with machine English translation.

* cited by examiner

STEEL MATERIAL AND MOLD

TECHNICAL FIELD

The present invention relates to a steel material and a mold, and more particularly to a steel material suitable for producing a mold having a large mass and a large size, and a mold using the same.

BACKGROUND

Since stress and heat repeatedly act on a mold during use, a steel material for the mold is required to be excellent in a plurality of properties such as hardness, impact resistance, heat check resistance, and wear resistance. Therefore, various proposals have been made in the related art regarding a steel material having such properties.

For example, Patent Literature 1 discloses a hot working tool steel containing predetermined contents of C, Si, Mn, Cr, Mo, and V, with the balance being Fe and unavoidable impurities.

Patent Literature 1 discloses that (A) in the case where the content of Si is set to 0.01 mass % or more and less than 0.25 mass %, a hot working tool steel can be obtained that has machinability enough to be industrially processed into a mold shape and has a thermal conductivity higher than that of a general-purpose mold steel (for example, JIS SKD61), and (B) in the case where the content of Mn, the content of Cr, the content of Mo, and the content of V are optimized, a hot working tool steel having high hardenability and a high impact value can be obtained.

A mold production process generally includes (a) a first step of producing a steel material suitable for mold production, and (b) a second step of producing a mold from the obtained steel material.

The first step (a step of producing a steel material for a mold) includes various steps. Main steps thereof include a melting step, a refining step, a casting step, a homogenization heat treatment step, a hot working step, a normalizing step, a tempering step, and a spheroidizing annealing step. Among these, one or more of the normalizing step, the tempering step, and the spheroidizing annealing step may be omitted.

The second step (a step of producing a mold from a steel material) includes the following two processes.

The first process is HT process. The HT process generally includes (a) a step of machining (rough machining) a spheroidized annealed steel material into a rough mold shape, (b) a step of performing hardening (H) and tempering (T) on the roughly machined mold, (c) a step of performing finish machining on the hardened and tempered mold, and (d) if necessary, a step of performing surface modification on the finished mold.

The second process is PH process. The PH process generally includes (a) a step of performing hardening and tempering on a steel material (not necessarily a spheroidized annealed steel material) and refining the steel material to an appropriate hardness (pre-hardening (PH)), (b) a step of performing machining (finishing) on the refined steel material, and (c) if necessary, a step of performing surface modification on the machined mold.

For example, most die-casting molds are produced by the HT process, but if a required hardness of a mold is low, the PH process may be used.

Properties required for a steel material subjected to the PH process and a mold produced by the PH process include (1) good machinability, (2) a high impact value in the case where a hardening rate is low, and (3) a small difference in hardness between a surface portion and a center portion (hardness homogeneity).

In order to obtain a high impact value even in the case where the hardening rate is low, it is necessary to satisfy three factors of (a) a small amount of coarse foreign matters, (b) a small amount of carbides and carbonitrides distributed in a dot array, and (c) high hardenability.

However, it is not easy to produce a steel material that satisfies all of the above three factors of properties.

Patent Literature 1: JP2011-001572A

SUMMARY

A problem to be solved by the present invention is to provide a steel material that is suitable for the PH process, that is, a steel material that is good in all three properties of machinability, impact value, and hardness homogeneity.

Another problem to be solved by the present invention is to provide a steel material that is good in all three properties of machinability, impact value, and hardness homogeneity even in the case where both the mass and size of the steel material are large.

Furthermore, another problem to be solved by the present invention is to provide a mold produced from such a steel material.

In order to solve the above problems, a steel material according to the present invention contains:

0.19 mass %≤C≤0.31 mass %;
0.010 mass %≤V≤0.180 mass %;
Mn≤1.50 mass %;
5.60 mass %≤Cr≤6.60 mass %;
Cu+Ni≤0.84 mass %;
0.40 mass %≤Si≤1.40 mass %;
0.60 mass %≤Mo≤2.00 mass %;
0.001 mass %≤Al≤0.080 mass %; and
0.003 mass %≤N≤0.040 mass %,
with a balance being Fe and unavoidable impurities, in which the contents of Mn and Cr satisfy Mn/Cr>0.150.

The steel material according to the present invention preferably:

has a mass of 3000 kg or more, and
has a minimum dimension ($L_{min}$) of 300 mm or more among a longitudinal dimension ($L_1$), a lateral dimension ($L_2$), and a height dimension ($L_3$).

The steel material according to the present invention preferably has a hardness of 35 HRC or more and 45 HRC or less at a center portion.

Furthermore, a mold according to the present invention is produced from the steel material according to the present invention and has a mass of 2000 kg or more.

There are two major features of the steel material according to the present invention. The first feature is that the content of C and the content of V are relatively small. Therefore, it is possible to prevent a decrease in the impact value caused by coarse foreign matters and by carbides and carbonitrides distributed in a dot array. On the other hand, in the case where the content of C and the content of V are small, austenite crystal grains during hardening tend to become coarser. However, even in the case where the content of C and the content of V are small, by adding appropriate amounts of Al and N and adjusting hardening conditions, it is possible to prevent the decrease in the impact value due to the coarsening of the austenite crystal grains during hardening.

The second major feature is that the content of Cr and the content of Mn are individually defined, and at the same time, a parameter "Mn/Cr" is introduced, so as to find optimum ranges of the content of Mn and the content of Cr. Optimizing the content of Mn and the content of Cr prevents a decrease in the impact value due to a decrease in hardenability, and improves hardness homogeneity.

Especially, a "spheroidizing annealing (SA) property" and the "hardenability", and the "hardenability" and the "hardness homogeneity" are properties for which influences of elements are contradictory to each other. Among these, the steel material subjected to the PH process do not necessarily require the SA property. Since the steel material according to the present invention optimizes the content of Cr and the content of Mn, it is possible to achieve both the hardenability and the hardness homogeneity.

Further, in general, the "machinability" and the "heat check resistance" are properties for which influences of elements are contradictory to each other. Among these, the machinability is more important than the heat check resistance for a steel material subjected to the PH process. Since the steel material according to the present invention has an optimized content of Si, it is possible to improve the machinability without significantly reducing the heat check resistance.

EMBODIMENTS

Figure 1:
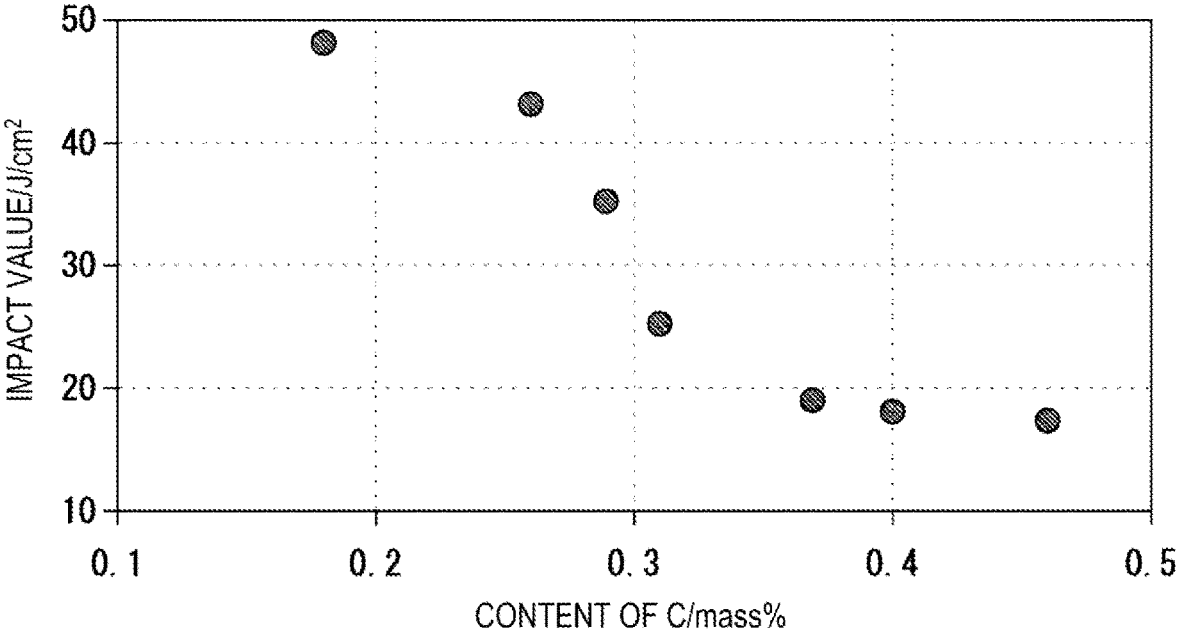
FIG. 1 is a graph showing a relation between the content of C and impact value.

An embodiment of the present invention will be described in detail below.

[1. Steel Material]

[1.1. Composition]

[1.1.1. Main Constituent Element]

A steel material according to the present invention contains the following elements, with the balance being Fe and unavoidable impurities. Types of additive elements, component ranges thereof, and reasons for limitation thereof are as follows.

(1) 0.19 Mass %≤C≤0.31 Mass %:

Fine particles (carbides, carbonitrides) having a diameter of less than 0.5 μm function as "pinning particles" that prevent growth of austenite crystal grains during heating for hardening. In the case where the content of C is too small, the amount of pinning particles becomes insufficient during heating for hardening. As a result, crystal grains may be coarsened, and steel material properties such as impact value, fracture toughness value, and ductility may be deteriorated.

In the case where the content of C is too small, the martensite transformation start temperature (Ms point) becomes excessively high. As a result, hardenability is increased, but the impact value may be decreased.

Further, in the case where the content of C is too small, it is difficult to obtain hardness of 35 HRC or more (preferably 36 HRC or more) by tempering at 560° C. to 600° C.

Therefore, the content of C needs to be 0.19 mass % or more. The content of C is preferably 0.20 mass % or more, and more preferably 0.21 mass % or more.

On the other hand, in the case where the content of C is excessive, coarse carbides or carbonitrides may be crystallized during casting. These crystallized matters become "foreign matters" that reduce the impact value. It is difficult to dissolve and eliminate the coarse foreign matters by a heat treatment (homogenization heat treatment and normalizing). Even after hardening and tempering, the coarse foreign matters may remain without being completely dissolved, and may be observed in a state of having a diameter exceeding 3 μm. The foreign matters that remain without being completely dissolved become a starting point of fracture and causes a decrease in the impact value and fatigue strength.

Further, in the case where an ingot is formed into a block-shaped or bar-shaped steel material by hot working, when a cooling rate after the hot working is low, carbides or carbonitrides may precipitate in a dot array, and the impact value may decrease. In the case where the content of C is excessive, this phenomenon becomes conspicuous.

Therefore, the content of C needs to be 0.31 mass % or less. The content of C is preferably 0.30 mass % or less, and more preferably 0.29 mass % or less.

(2) 0.010 Mass %≤V≤0.180 Mass %:

V is bonded to C and/or N in a steel to form a carbide, a carbonitride, and/or a nitride. All of these function as the pinning particles. Therefore, in the case where the content of V is too small, the amount of pinning particles is insufficient during heating for hardening.

In the case where the content of V is too small, a degree of secondary curing during tempering is decreased. As a result, in the case of tempering under 560° C. to 600° C., it is difficult to obtain a hardness of 35 HRC or more (preferably 36 HRC or more).

Therefore, the content of V needs to be 0.010 mass % or more. The content of V is preferably 0.013 mass % or more, and more preferably 0.016 mass % or more.

On the other hand, in the case where the content of V becomes excessive, coarse foreign matters and/or carbides or carbonitrides distributed in a dot array increase. As a result, the phenomenon that the impact value decreases may become conspicuous. Furthermore, the content of V becoming excessive increases a cost of the steel material and goes against resource saving.

Therefore, the content of V needs to be 0.180 mass % or less. The content of V is preferably 0.170 mass % or less, and more preferably 0.160 mass % or less.

(3) Mn/Cr>0.150:

The ratio (Mn/Cr) of the mass of Mn to the mass of Cr contained in the steel affects spheroidizing annealing (SA) property. Generally, the smaller the Mn/Cr, the better the SA property. Therefore, in the case of a steel material to be subjected to the HT process, it is preferable to reduce Mn/Cr in order to ensure a high SA property that allows sufficient softening with simple SA. However, in order to keep Mn/Cr small, Mn cannot be increased, and there is a limit in improvement of hardenability.

In contrast, in the case of a steel material to be subjected to the PH process, the SA property is less important. On the other hand, in the case where a large steel material or mold is targeted in the PH process, high hardenability is important.

In order to obtain high hardenability, Mn/Cr needs to exceed 0.150. Mn/Cr is preferably 0.155 or more, and more preferably 0.160 or more.

(4) Mn≤1.50 Mass %:

Mn affects hardenability. Generally, the larger the content of Mn, the better the hardenability. However, in the case where the content of Mn becomes excessive, thermal conductivity decreases and heat check resistance deteriorates. In the case where the content of Mn becomes excessive, the amount of retained austenite increases. Retained austenite may decompose during tempering, but regardless of whether it decomposes or not, retained austenite may have an adverse effect on the properties of the steel material. Therefore, the content of Mn needs to be 1.50 mass % or less. The content of Mn is preferably 1.45 mass % or less, and more preferably 1.40 mass % or less.

(5) 5.60 Mass %≤Cr≤6.60 Mass %:

Cr affects hardenability, hardness homogeneity, and high-temperature strength. In the case where the content of Cr becomes too small, the hardenability and the hardness homogeneity decrease. The high-temperature strength also decreases. Therefore, the content of Cr needs to be 5.60 mass % or more. The content of Cr is preferably 5.70 mass % or more, and more preferably 5.80 mass % or more.

On the other hand, in the case where the content of Cr is excessive, softening resistance decreases. That is, a surface of a mold that is in contact with a molten metal during use as a die-casting mold is heated to a high temperature, and the surface of the mold heated to a high temperature is likely to be softened. In the case where high-temperature strength is decreased due to the softening, heat check resistance is also deteriorated. In addition, softening of a region with a hardness exceeding maximum hardness is remarkable, and it is difficult to adjust tempering hardness. This is because hardness is sensitive to a change in furnace temperature.

In the case where the content of Cr is excessive, thermal conductivity is decreased. As a result, thermal stress is increased and heat check resistance is deteriorated. In the case where the content of Cr becomes excessive, Cr-based carbides precipitate at grain boundaries after hot working, causing a decrease in the impact value. Further, in the case where the content of Si is 0.50 mass % or less, when the content of Cr is increased, machinability is significantly decreased.

Therefore, the content of Cr needs to be 6.60 mass % or less. The content of Cr is preferably 6.50 mass % or less, and more preferably 6.40 mass % or less.

(6) Cu+Ni≤0.84 Mass %:

In the present invention, as described above, hardenability and softening resistance are ensured by balance between Cr and Mn (content of Cr, content of Mn, and Mn/Cr ratio). On the other hand, Cu and Ni both have an effect of increasing hardenability and softening resistance, but the effect is not so great. On the contrary, in the case where the content of Cu+Ni becomes excessive, negative effects described below become noticeable. Therefore, Cu and Ni are defined by a total content thereof, and the total content is defined by a range in which influence on the hardenability is small as an upper limit.

There is a "hardenability property value" used as an index of an effect of an alloy element on improving hardenability of a steel. The hardenability property value means that the larger the value, the higher the effect on improving hardenability. The hardenability property value is determined for type of alloy element and the addition amount thereof. The hardenability of steels having different components is evaluated by an added value of hardenability property values corresponding to the types and contents of alloy elements.

Here, the hardenability property value is 0.125 in the case where 0.10 mass % of Mn is added. On the other hand, the hardenability property value is 0.062 in the case where 0.42 mass % of Ni is added, and the hardenability property value is also 0.062 in the case where 0.42 mass % of Cu is added. That is, the hardenability property value (the added value) is 0.124 in the case where 0.42 mass % each of Cu and Ni is added (addition of 0.84 mass % in total). This value is substantially equal to the hardenability property value (=0.125) in the case where 0.10 mass % of Mn is added. It means that in the case where the content of Cu+Ni is 0.84 mass % or less, influence on an improvement of the hardenability is small. In the case where the content of Cu+Ni is about 0.84 mass %, influence on an increase in the high-temperature strength is also small.

On the other hand, in the case where the content of Cu+Ni is more than 0.84 mass %, various problems become apparent. Specifically, cracking easily occurs during hot working, the amount of retained austenite increases, thermal conductivity decreases, cost increases, and the like. Therefore, the content of Cu+Ni needs to be 0.84 mass % or less. In the present invention, since it is necessary to satisfy the condition of Mn/Cr>0.150, the total content of Mn and Cr that contribute to an improvement of hardenability exceeds 6.44 mass % (see FIG. 6). Therefore, it is clear that in the case where the content of Cu+Ni is 0.84 mass % or less, the hardenability will not be greatly affected. The content of Cu+Ni is preferably 0.78 mass % or less, and more preferably 0.72 mass % or less.

(7) 0.40 Mass %≤Si≤1.40 Mass %:

In the case where the content of Si is too small, machinability is decreased, and it is difficult to industrially and stably perform machining on a large mold. Especially, since the steel material of the present invention is intended for producing a large mold, the amount to be cut is large, and good machinability is required. Therefore, the content of Si needs to be 0.40 mass % or more. The content of Si is preferably 0.45 mass % or more, and more preferably 0.50 mass % or more.

On the other hand, in the case where the content of C, the content of V, and the content of N are large, when the content of Si is excessive, coarse crystallized substances and/or carbides or carbonitrides distributed in a dot array may be increased.

For a steel material to be subjected to the PH process, good machinability is more important than high heat check resistance. However, in the case where the content of Si becomes excessive, thermal conductivity decreases. As a result, in the case of being used as a die-casting mold, thermal stress may increase and heat check resistance may deteriorate. In the case where the heat check resistance is excessively reduced, it is difficult to use as a die-casting mold. Therefore, the content of Si needs to be 1.40 mass % or less. The content of Si is preferably 1.30 mass % or less, and more preferably 1.20 mass % or less.

(8) 0.60 Mass %≤Mo≤2.00 Mass %:

In the case where the content of Mo is too small, a degree of secondary curing during tempering is decreased. Therefore, in the case where the content of Mo becomes too small, it is difficult to obtain a hardness of 35 HRC or more (preferably 36 HRC or more) when tempering under 560° C. to 600° C. In addition, softening resistance and high-temperature strength may be insufficient, and heat check resistance may be deteriorated. Therefore, the content of Mo needs to be 0.60 mass % or more. The content of Mo is preferably 0.70 mass % or more, and more preferably 0.80 mass % or more.

On the other hand, in the case where the content of Mo is excessive, machinability is decreased. Especially, in the case where the content of Si is small, when the content of Mo is excessive, machinability is significantly decreased. In the case where the content of Mo is excessive, fracture toughness may be decreased. This tendency is apparent in the case where the content of Si is large. Furthermore, the content of Mo becoming excessive increases cost of the steel material and goes against resource saving. Therefore, the content of Mo needs to be 2.00 mass % or less. The content of Mo is preferably 1.95 mass % or less, and more preferably 1.90 mass % or less.

(9) 0.001 Mass %≤Al≤0.080 Mass %:

In the steel material according to the present invention, the content of C and the content of V are much smaller than those of hot working die steel (SKD61) in the related art. Therefore, amounts of V-based carbides, carbonitrides, and nitrides serving as pinning particles during heating for hardening are smaller than those in SKD61. Therefore, in the present invention, AlN particles are also used to prevent the growth of austenite crystal grains.

In the case where the content of Al is too small, it is difficult to reduce oxygen during refining, and the amount of oxides is increased, which may decrease the impact value. In the case where the content of Al is too small, the amount of AlN serving as pinning particles is insufficient. As a result, austenite crystal grains may be coarsened during heating for hardening, and the impact value, fracture toughness, and/or ductility may be decreased. Therefore, the content of Al needs to be 0.001 mass % or more. The content of Al is preferably 0.002 mass % or more, and more preferably 0.003 mass % or more.

On the other hand, in the case where the content of Al is excessive, coarse alumina particles may be increased, and the impact value and fatigue strength may be decreased. In addition, thermal conductivity may be decreased, and heat check resistance may be deteriorated. Therefore, the content of Al needs to be 0.080 mass % or less. The content of Al is preferably 0.070 mass % or less, and more preferably 0.060 mass % or less.

Note that in the case where Ca is added in order to improve machinability, the content of Al is extremely important for optimizing a form of a compound.

(10) 0.003 Mass %≤N≤0.040 Mass %:

In the present invention, in order to disperse AlN particles in the austenite phase during heating for hardening, the content of N is also specified in addition to the content of Al. In the case where the content of N is too small, the amount of AlN serving as pinning particles is insufficient. As a result, the austenite crystal grains may be coarsened during heating for hardening, and impact value, fracture toughness value, and/or ductility may be decreased. In the case where the content of N is too small, the amounts of the V-based carbonitrides and nitrides which also serve as pinning particles may be insufficient. Therefore, the content of N needs to be 0.003 mass % or more. The content of N is preferably 0.004 mass % or more, and more preferably 0.005 mass % or more.

On the other hand, in order to add N in an amount exceeding the amount that can be adjusted in normal refining, it is necessary to positively add N by using a dedicated equipment, which increases a material cost. In addition, in the case where the content of N becomes excessive, coarse crystallized substances and/or carbides and carbonitrides distributed in a dot array may increase. This tendency is apparent in the case where the content of C, the content of Si, and the content of V are large. In addition, in the case where the content of N is excessive, an amount of coarse AlN may be excessively large, and impact value may be decreased. Furthermore, in the case where the content of N is excessive, N in the steel material may evaporate when repairing the mold by welding, which may cause defects formed inside or on a surface of the welded portion. Therefore, the content of N needs to be 0.040 mass % or less. The content of N is preferably 0.038 mass % or less, and more preferably 0.036 mass % or less.

(11) Unavoidable Impurities:

The steel material according to the present invention may include unavoidable impurities. Elements that can be included as impurities in the steel material according to the present invention and contents thereof are as follows. P≤0.03 mass %, S≤0.006 mass %, 0≤0.006 mass %, W≤0.30 mass %, Co≤0.30 mass %, B≤0.0002 mass %, Nb≤0.004 mass %, Ta≤0.004 mass %, Ti≤0.004 mass %, Zr≤0.004 mass %, Ca≤0.0005 mass %, Se≤0.03 mass %, Te≤0.005 mass %, Bi≤0.01 mass %, Pb≤0.03 mass %, and Mg≤0.02 mass %.

In the present invention, the "content" refers to an "average content of element in the steel material" obtained by dissolving a predetermined mass of a steel material (preferably 1 g or more per analysis of one element) including a portion with a high segregation, a portion with a low segregation, and a portion with an average segregation, in an acid, and using a chemical analysis method.

[1.1.2. Sub Constituent Element]

The steel material according to the present invention may further contains one or two or more elements described below in addition to the main constituent elements and the unavoidable impurities described above. Types of additive elements, component ranges thereof, and reasons for limitation thereof are as follows.

[A. Group A]

(12) 0.30 Mass %<W≤2.00 Mass %:

In the steel material according to the present invention, the content of C and the content of V are smaller than those of the hot working die steel in the related art, and thus strength may be insufficient depending on an application. In such a case, it is effective to add W for increasing strength. In order to obtain such an effect, the content of W preferably exceeds 0.30 mass %. The content of W is more preferably 0.80 mass % or more.

On the other hand, in the case where the content of W is excessive, the material cost is increased. In addition, segregation may become explicit, which may cause deterioration of mechanical properties or an increase in anisotropy. Therefore, the content of W is preferably 2.00 mass % or less. The content of W is more preferably 1.50 mass % or less.

(13) 0.30 Mass %<Co≤1.00 Mass %:

As with W, Co has an effect of increasing strength. Therefore, in the case where strength is insufficient, it is effective to add Co for increasing strength. In order to obtain such an effect, the content of Co preferably exceeds 0.30 mass %. The content of Co is more preferably 0.50 mass % or more.

On the other hand, in the case where the content of Co is excessive, the material cost is increased. In addition, segregation may become explicit, which may cause deterioration of mechanical properties or an increase in anisotropy. Therefore, the content of Co is preferably 1.00 mass % or less. The content of Co is more preferably 0.90 mass % or less.

The steel material according to the present invention may include either or both of Co and W.

[B. Group B]

(14) 0.0002 Mass %<B≤0.0080 Mass %:

In the case where the content of P in the steel material is relatively large, P segregated in grain boundaries decreases grain boundary strength, and the impact value is decreased. Addition of B is effective for increasing the grain boundary strength. In order to increase grain boundary strength, B needs to be present alone (without forming a compound) in the steel. In the case where B forms BN, the effect of the addition of B is lost. Therefore, in the steel material containing N, in the case where B is added for the purpose of increasing grain boundary strength, N needs to be bonded to an element other than B.

Specifically, N is preferably bonded to a nitride-forming element such as Ti, Zr, or Nb, which easily forms a nitride. These elements are effective even in a content at an impurity level, but in the case where the elements are insufficient, it is preferable to add these elements with contents exceeding the impurity level.

Note that BN has an effect of improving machinability of the steel material. Therefore, in the case where B is added for the purpose of improving machinability, it is not necessary to positively add the nitride-forming element to the steel material.

In order to obtain the above effect, the content of B preferably exceeds 0.0002 mass %. The content of B is more preferably 0.0003 mass % or more, and still more preferably 0.0004 mass % or more.

On the other hand, even in the case where B is added more than necessary, there is no difference in the effect, and there is no practical benefit. In the case where the content of B is excessive, the cost of the steel material is increased. Therefore, the content of B is preferably 0.0080 mass % or less. The content of B is more preferably 0.0075 mass % or less, and still more preferably 0.0070 mass % or less.

[C. Group C]

(15) 0.006 Mass %<S≤0.180 Mass %:

(16) 0.0005 Mass %<Ca≤0.0500 Mass %:

(17) 0.03 Mass %<Se≤0.50 Mass %:

(18) 0.005 Mass %<Te≤0.100 Mass %:

(19) 0.01 Mass %<Bi≤0.50 Mass %:

(20) 0.03 Mass %<Pb≤0.50 Mass %:

In the steel material according to the present invention, addition of free-cutting elements is effective for improving machinability. Specific examples of the free-cutting element include S, Ca, Se, Te, Bi, and Pb. The steel material according to the present invention may include any one of these free-cutting elements, or may include two or more thereof.

In order to obtain a sufficient free-cutting property, the contents of the free-cutting elements are preferably greater than the above respective lower limits.

On the other hand, in the case where the content of the free-cutting element is excessive, a crack is likely to occur during hot working. In addition, in the case where the content of the free-cutting element is excessive, impact value, fatigue strength, heat check resistance, and the like may be decreased. Therefore, the contents of the free-cutting elements are preferably equal to or less than the above respective upper limits.

[D. Group D]

(21) 0.004 Mass %<Nb≤0.100 Mass %:

(22) 0.004 Mass %<Ta≤0.100 Mass %:

(23) 0.004 Mass %<Ti≤0.100 Mass %:

(24) 0.004 Mass %<Zr≤0.100 Mass %:

In the steel material according to the present invention, a carbonitride-forming element other than V and Al may be added to increase the amounts of carbides, carbonitrides, and/or nitrides. Specific examples of the carbonitride-forming element include Nb, Ta, Ti, and Zr. The steel material according to the present invention may include any one of these carbonitride-forming elements, or may include two or more thereof.

In order to prevent excessive grain growth of austenite crystal grains, the contents of the carbonitride-forming elements are preferably greater than the above respective lower limits.

On the other hand, in the case where the contents of the carbonitride-forming elements are excessive, the carbides, the carbonitrides, and/or the nitrides are crystallized in a coarse state during casting. Coarse crystallized particles remain as a foreign matter without being eliminated even during homogenization heat treatment, SA, and hardening, which causes a decrease in impact value and fatigue strength. Therefore, the contents of the carbonitride-forming elements are preferably equal to or less than the above respective upper limits.

[1.2. Properties of Steel Material]

[1.2.1. Mass and Size]

As described above, properties required for a steel material to be subjected to the PH process and for a mold produced by the PH process include three properties of machinability, impact value, and hardness homogeneity. Among these three properties, a problem with a large steel material is a low impact value inside a large mold produced from the large steel material.

The first reason for the decrease in the impact value of the large mold is that a large foreign matter is likely to be crystallized inside the large steel material. This is because a solidification rate during ingot production is low inside the large steel material.

The second reason for the decrease in the impact value of the large mold is that a cooling rate after hot working is low, so that carbides and carbonitrides tend to precipitate in a dot array.

The third reason for the decrease in the impact value of the large mold is that a hardening rate is decreased inside the large steel material.

In the steel material according to the present invention, the content of C and the content of V are small, and the content of Mn and the content of Cr are optimized, and thus influences of the large foreign matter, low cooling rate after hot working, and low hardening rate are small. That is, in the steel material according to the present invention, even in the case where the mass and size thereof are large, the three properties of the machinability, impact value, and hardness homogeneity can be all achieved at a high level.

For example, in the case where the composition and production conditions of the steel material are optimized, a steel material having a mass of 3000 kg or more can be obtained in addition to all of the three properties reaching a practical level. In the case where the composition and production conditions of the steel material are further optimized, even a steel material having a mass of 4000 kg or more or 5,000 kg or more can be produced.

In the case where the composition and production conditions of the steel material are optimized, a steel material having the above properties and having a minimum dimension ($L_{min}$) of 300 mm or more among a longitudinal dimension (L), a lateral dimension ($L_2$), and a height dimension ($L_3$) can be obtained. In the case where the composition and production conditions of the steel material are further optimized, even a steel material having Lun of 350 mm or more or 400 mm or more can be produced.

Here, the "longitudinal dimension ($L_1$)", the "lateral dimension ($L_2$)", and the "height dimension ($L_3$)" refer to lengths of three sides of a rectangular parallelepiped body with a minimum volume that circumscribes the steel material, respectively.

[1.2.2. Hardness]

A. Definition

In the present invention, the "hardness of the steel material" refers to a Rockwell C scale hardness obtained by (a) cutting out a test piece from a vicinity of a center (a region where the hardening rate is low) or a vicinity of an outer periphery (a region where the hardening rate is high) of a cross section of a steel material refined to a predetermined hardness, and (b) performing measurement at room temperature by using the test piece.

Figure 9:
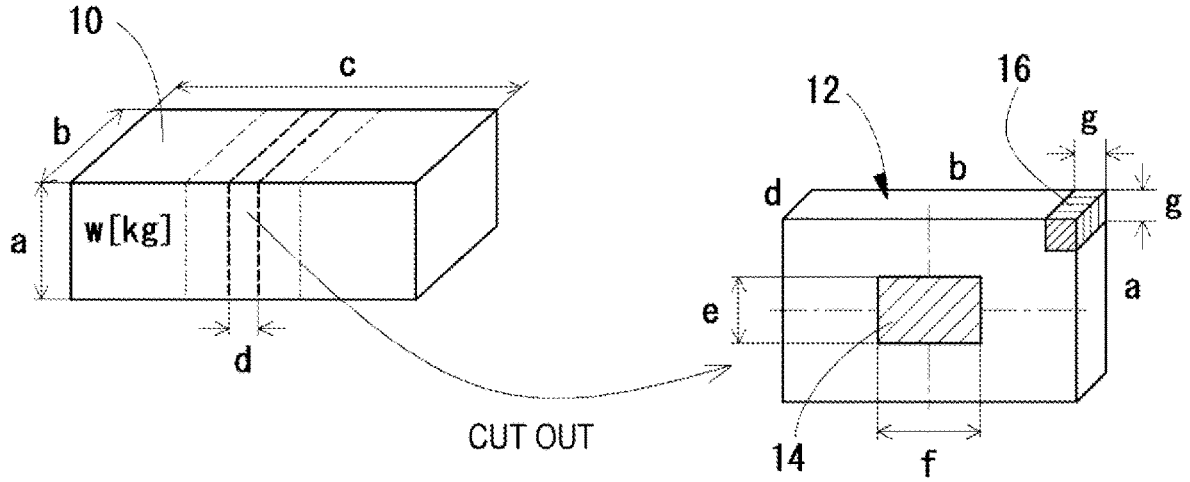
FIG. 9 is a schematic diagram for explaining a cut-out position of a test piece.

FIG. 9 shows a schematic diagram illustrating a cut-out position of the test piece. For example, in the case where the steel material is a block material 10 of a [mm]×b [mm]×c [mm] ($a \leq b \leq c$, $a \geq 300$ mm), a first material 12 of a [mm]×b [mm]×d [mm] is cut out from the vicinity of the center in a c-axis direction. The value of d is not particularly limited, and is preferably 30 mm to 70 mm. The "vicinity of the center" refers to a central region when the block material 10 is divided into three equal parts along the c-axis direction (maximum length direction of the block material 10). The first material 12 is cut out from an arbitrary position in the "vicinity of the center".

Next, a second material 14 of e [mm]×f [mm]×d [mm] is cut out from a center portion of an ab surface of the first material 12. As for the values of e and f, it is preferable to select optimal values according to the size of the ab surface, the purpose of evaluation, and the like. For example, it is preferable that in the case where a=600 mm to 800 mm and b=900 mm to 1, 100 mm, e=90 mm to 120 mm and f=130 mm to 160 mm.

A third material 16 of g [mm]×g [mm]×d [mm] is cut out from the outer periphery of the first material 12. The cut-out position of the third material 16 is not particularly limited, and is preferably a corner of the first material 12. The value of g is not particularly limited, and is preferably 40 mm to 60 mm. Furthermore, test pieces for hardness measurement are cut out from the second material 14 and the third material 16, respectively, and the hardness is measured by using these test pieces.

That is, more specifically, the "hardness of the center portion" refers to the Rockwell C scale hardness measured by using a sample cut out from the center portion of the first material 12.

The "hardness of the outer periphery" refers to the Rockwell C scale hardness measured by using a sample cut out from the outer periphery of the first material 12 and without decarburization.

The "center portion" refers to a region from a center of gravity of a cross section of the first material 12 to $R_A/2$ when drawing a random straight line radially from the center of gravity of the cross section of the first material 12 toward an outer edge of the cross section, taking an intersection of each straight line and the outer edge of the cross section as A, and taking a distance to the intersection A from the center of gravity as $R_A$.

The "outer periphery" refers to a region outside the center portion.

B. Heat Treatment Conditions

Heat treatment conditions (hardening conditions and tempering conditions) for refining the steel material are not particularly limited as long as desired hardness can be obtained.

The optimum hardening temperature varies depending on the composition of the steel material. The hardening temperature is usually 880° C. to 980° C. The cooling rate during hardening varies depending on the size of the steel material and a cooling method. For a large steel material, the cooling rate at the center portion is usually 10° C./min or less in a cooling section from 800° C. to 200° C.

Similarly, the optimum tempering temperature varies depending on the composition of the steel material. The tempering temperature is usually 560° C. to 600° C. In the case where the steel material cannot be refined to a predetermined hardness with one time of tempering, it is preferable to repeat the tempering multiple times.

C. Hardness Homogeneity

The steel material according to the present invention can achieve a high hardness even in the case where the mass and size are relatively large. Furthermore, the difference in hardness between the vicinity of the outer periphery where the cooling rate is fast, and the vicinity of the center where the cooling rate is slow, is small, that is, hardness homogeneity is high.

By optimizing the composition and production conditions of the steel material, the hardness ($H_1$) of the outer periphery at room temperature will be 36 HRC to 44 HRC. By further optimizing the composition and production conditions of the steel material, $H_1$ becomes 37 HRC to 43 HRC or 38 HRC to 42 HRC.

By optimizing the composition and production conditions of the steel material, the hardness ($H_2$) of the center portion at room temperature will be 35 HRC to 45 HRC. By further optimizing the composition and production conditions of the steel material, $H_2$ becomes 36 HRC to 44 HRC or 37 HRC to 43 HRC.

Furthermore, by optimizing the composition and production conditions of the steel material, the absolute value of the difference between $H_1$ and $H_2$ ($\Delta H = |H_1 - H_2|$) is 3.5 HRC or less.

[1.2.3. Impact Value]

In the present invention, the "impact value of the steel material" refers to an impact value obtained by (a) cutting out an impact test piece from the vicinity of the center (the region where the solidification rate and the hardening rate are low) of the cross section of a steel material refined to a predetermined hardness, and (b) performing an impact test at 15° C. to 35° C.

The cut-out position of the impact test piece was in the vicinity of the center of the cross section of the steel material. That is, the impact test piece is cut out from the second material 14 illustrated in FIG. 9.

The heat treatment conditions (hardening conditions and tempering conditions) for refining the steel material are as described above, and therefore description thereof will be omitted.

The "impact test piece" refers to a test piece in accordance with JIS Z2242 (10 mm×10 mm×50 mm, an arc radius of a notch tip: 1 mm, a notch depth: 2 mm, a cross-sectional area of the test piece at a lower portion of a notch bottom: 0.8 $cm^2$).

The "impact value ($J/cm^2$)" refers to a value obtained by dividing an absorption energy [J] by the cross-sectional area (0.8 [$cm^2$]) of the test piece at the lower portion of the notch bottom.

The "average impact value ($J/cm^2$)" refers to an average value of impact values of 10 or more (preferably 10 to 20) impact test pieces.

The "low-impact value ratio (%)" refers to a ratio ($=n\times 100/n_0$) of the number (n) of impact test pieces having an impact value of less than 20 [$J/cm^2$] to a total number (no) of impact test pieces subjected to the impact test.

In the steel material according to the present invention, in the case where the composition and production conditions are optimized, a steel material that exhibits a high impact value in spite of a large size and has a small variation in the impact value can be obtained.

Specifically, in the case where the composition and production conditions are optimized, a steel material having an average impact value of 25 [$J/cm^2$] or more and a low-impact value ratio of 30% or less can be obtained.

In the case where the composition and production conditions are further optimized, the average impact value is 26 [$J/cm^2$] or more or 27 [$J/cm^2$] or more.

In addition, in the case where the composition and production conditions are further optimized, the low-impact value ratio is 20% or less or 10% or less.

[2. Mold]

A mold according to the present invention is made of the steel material according to the present invention and has the following properties.

[2.1. Mass and Size]

The steel material according to the present invention is excellent in machinability, impact value, and hardness homogeneity even in the case where the mass and size thereof are relatively large. Therefore, when such a steel material is used, a mold excellent in impact value and hardness homogeneity can be obtained even in the case where the mass and size thereof are relatively large.

In the case where the composition and production conditions of the mold are optimized, a mold having a mass of 2000 kg or more can be obtained in addition to impact value and hardness homogeneity thereof reaching a practical level. In the case where the composition and production conditions of the mold are further optimized, even a mold having a mass of 3000 kg or more or 4000 kg or more can be produced.

In the case where the composition and production conditions of the mold are optimized, a mold having the above properties and having a minimum dimension ($L'_{min}$) of 250 mm or more among a longitudinal dimension ($L'_1$), a lateral dimension ($L'_2$), and a height dimension ($L'_3$) can be obtained. In the case where the composition and production conditions of the mold are further optimized, even a mold having $L'_{min}$ of 300 mm or more or 350 mm or more can be produced.

Here, the "longitudinal dimension ($L'_1$)", the "lateral dimension ($L'_2$)", and the "height dimension ($L'_3$)" refer to lengths of three sides of a rectangular parallelepiped body with a minimum volume that circumscribes the mold, respectively.

[2.2. Hardness, Impact Value, and Hardness Homogeneity]

The steel material according to the present invention is particularly suitable as a steel material to be subjected to the PH process. The mold produced by the PH process has equivalent hardness, impact value, and hardness homogeneity as the steel material after refining. Details of the hardness, impact value, and hardness homogeneity are as described above, and therefore, description thereof is omitted.

[3. Method for Producing Steel Material]

A method for producing the steel material according to the present invention includes (a) a first step of melting raw materials blended to have a predetermined composition, refining the molten metal, and casting the molten metal into an ingot mold, (b) a second step of performing a homogenization heat treatment on the ingot, (c) a third step of performing a hot working on the ingot after the homogenization heat treatment, (d) if necessary, a fourth step of normalizing the roughly-shaped material after the hot work, (e) if necessary, a fifth step of tempering the roughly-shaped material, (f) if necessary, a sixth step of performing spheroidizing annealing on the roughly-shaped material, and (g) a seventh step of hardening and tempering the roughly-shaped material.

[3.1. First Step]

First, raw materials blended to have the predetermined composition are melted, the molten metal is refined, and the molten metal is cast in an ingot mold (first step). Melting conditions, refining conditions, and casting conditions are not particularly limited, and optimum conditions can be selected according to the purpose.

[3.2. Second Step]

Next, the obtained ingot is subjected to a homogenization heat treatment (second step). The homogenization heat treatment is performed to homogenize components by diluting component segregation generated during solidification and dissolving a foreign matter crystallized during the solidification as much as possible. Conditions of the homogenization heat treatment are not particularly limited, and optimum conditions can be selected according to the purpose.

[3.3. Third Step]

Next, the ingot after the homogenization heat treatment is subjected to a hot working (third step). The hot working is performed to make the ingot into a roughly-shaped material having a desired shape. Conditions of the hot working are not particularly limited, and optimum conditions can be selected according to the purpose.

[3.4. Fourth Step]

Next, if necessary, the roughly-shaped material after the hot working is normalized (fourth step). The normalizing is performed in the case where it is necessary to homogenize and refine the structure of the roughly-shaped material. Normalizing conditions are not particularly limited, and optimum conditions can be selected according to the purpose. Note that the normalizing step may be omitted.

[3.5. Fifth Step]

Next, if necessary, the roughly-shaped material is tempered (fifth step). The tempering is performed in the case where it is necessary to temper martensite or bainite generated in a cooling process after the normalizing, or in the case where it is necessary to precipitate carbides in preparation for the spheroidizing annealing. Tempering conditions are not particularly limited, and optimum conditions can be selected according to the purpose. Note that the tempering step may be omitted.

[3.6. Sixth Step]

Next, if necessary, the roughly-shaped material is subjected to a spheroidizing annealing (sixth step).

The spheroidizing annealing is performed to obtain fine austenite crystal grains during heating for hardening in the seventh step. Note that the spheroidizing annealing step can be omitted.

[3.7. Seventh Step]

Next, the roughly-shaped material is hardened and tempered (seventh step). Hardening, and tempering performed after the hardening are performed to refine the steel material to a predetermined hardness. Hardening conditions and tempering conditions are not particularly limited as long as a predetermined hardness can be obtained.

[4. Method for Producing Mold]

The mold according to the present invention includes (a) a first step of machining (finishing) the steel material refined (pre-hardened (PH)) to an appropriate hardness, and (b) if necessary, a second step of performing a surface modification on the machined mold.

A method and conditions of each step are not particularly limited, and optimum methods and conditions can be selected according to the purpose.

[5. Effects]

Properties required for a steel material to be subjected to the PH process and for a mold produced by the PH process include (1) machinability, (2) an impact value in the case where a hardening rate is small, and (3) hardness homogeneity. Hereinafter, the reason for the necessity of these three properties will be described by mainly using die-casting as an example.

[5.1. Machinability]

A steel material to be subjected to machining is required not to cause much wear of a machining tool even when machined at a high speed. Severe tool wear increases a frequency of tool replacement, which increases machining costs. On the other hand, in the case where a machining speed is decreased in order to avoid the wear of the tool, machining efficiency is decreased. For the above reasons, the steel material for a mold is required to be able to be efficiently machined at a low cost, that is, to have "good machinability".

In the case of producing a mold by using the HT process, the steel material softened to 98 HRB (approximately 238 HV) or less by spheroidizing annealing is roughly processed, and therefore even if the amount of cutting is large, it is not as problematic as in the PH process.

On the other hand, in the PH process, a large amount of steel material hardened by hardening and tempering to 35 HRC (approximately 345 HV) or more is cut, and therefore if the machinability is poor, it is not commercially viable.

On the other hand, a steel material having good machinability generally contains Si, P, and/or S in large contents. A mold produced from such a steel material generally has poor heat check resistance. The "having poor heat check resistance" means that a heat check is likely to occur and is likely to be developed. Hereinafter, reasons will be described.

A high-Si steel material has low thermal conductivity. In the case where a mold produced from a steel material having low thermal conductivity is used for die-casting, the temperature amplitude on the surface of the mold increases, and thus a thermal stress is highly generated.

A mold produced from a high-P steel material has low toughness. Therefore, in the case where such a mold is used for die-casting, a crack is likely to occur and to be developed.

Further, the high-S steel material includes a relatively large amount of sulfide. In a mold produced from such a steel material, the sulfide serves as a starting point or a development path of a crack, and thus the crack is likely to occur and to be developed.

That is, a steel material containing Si, P, and/or S in a relatively large amount has good machinability. However, in the case where such a steel material is used as a mold, a high thermal stress acts on the matrix. Therefore, a heat check, which is a thermal fatigue crack, is likely to occur and to be developed. That is, the "good machinability" and "good heat check resistance" are opposite to each other.

On the other hand, the steel material according to the present invention contains substantially no P and no S (or may selectively contain a small content of S) and contains an optimized content of Si. By optimizing the composition of the steel material and the hardening and tempering conditions, the steel material can be refined to a hardness suitable for the PH process. Therefore, the steel material according to the present invention exhibits good machinability without significantly impairing heat check resistance.

[5.2. Impact Value in the Case where Hardening Rate is Low]

In the case of the PH process, the mold is produced from a steel material refined to a predetermined hardness. Therefore, the steel material used to produce the mold needs to have not only hardness but also a high impact value. The reason therefor is that a mold having a high impact value is less likely to be severely cracked.

In order to obtain a high impact value, it is necessary to satisfy the following three items. That is, (a) few coarse foreign matters, (b) few carbides and carbonitrides distributed in a dot array, and (c) high hardenability.

[5.2.1. Few Coarse Foreign Matters]

The "foreign matter" is a substance having a composition different from that of the matrix, and refers to a carbide, a nitride, a carbonitride, a sulfide, an oxide, and the like.

In the present invention, the "coarse foreign matter" refers to a foreign matter having a size (=equivalent circle diameter) of 3 μm or more.

When a stress acts on the mold, the coarse foreign matter is likely to become a starting point of a crack and become a propagation path of the crack that occurs. Therefore, in order to obtain a high impact value, the smaller the amount of coarse foreign matters, the better.

There are a foreign matter containing one metal element and a foreign matter containing two or more metal elements. Since a steel for a die-casting mold in the related art includes large contents of C and V, a coarse foreign matter is usually constituted by a carbide or carbonitride containing V. The size and the content of the V-based carbide or carbonitride are affected not only by chemical components of the steel material, but also by a solidification rate during casting, a temperature and a time of the homogenization heat treatment, and the like.

[5.2.2. Few Carbides and Carbonitrides Distributed in Dot Array]

In the case where the cooling rate after hot working is low, carbides or carbonitrides may precipitate at austenite grain boundaries depending on the composition. The shape of carbides or carbonitrides is rod-shaped, V-shaped, W-shaped, or wavy, and the size in a direction in which the longest length can be measured is 0.5 μm to 3 μm. Although such carbides or carbonitrides are smaller in size than the above-mentioned "coarse foreign matter", they are intermittently connected at grain boundaries and distributed in a dot array. Therefore, in the case where such carbides or carbonitrides exist, they are likely to break at grain boundaries, and the impact value will be greatly reduced.

[5.2.3. High Hardenability]

As the size of the steel material is increased, the cooling rate during hardening is decreased. This tendency is particularly remarkable inside the steel material. For this reason, in the case of producing a mold by using the PH process, when the steel material becomes larger due to a recent increase in the size of the mold, the cooling rate inside the steel material during hardening becomes smaller. As a result, a decrease in the impact value of a mold machined from a large steel material in the PH process becomes a problem.

[5.2.4. High Impact Value]

From the above circumstances, there is a strong demand for a steel material that can obtain a high impact value even in the case where a hardening rate is low, that is, a "steel material having good hardenability". In other words, the "having good hardenability" means that coarse bainite is not generated even in the case where the hardening rate is low.

On the other hand, the steel material having good hardenability has a poor SA property. This is because, in such a steel material, since carbides are difficult to be precipitated during slow cooling of SA and ferrite transformation is difficult to proceed, it is difficult to obtain an SA structure (a structure in which carbides are dispersed in a mother phase of ferrite).

On the other hand, it is not necessary to consider the SA property of the steel material to be subjected to the PH process. However, in order to obtain fine austenite crystal grains during heating for hardening in the post-process, spheroidizing annealing may be performed. The steel material according to the present invention exhibits good hardenability since the content of Cr and the content of Mn are optimized to be suitable for such a PH process.

[5.3. Hardness Homogeneity]

In order to refine the steel material to a predetermined hardness (35 HRC to 45 HRC), hardening and tempering are performed. In the case where a large steel material is hardened, the hardening rate differs between a surface side and an inner side. Therefore, ratios of phases such as martensite, bainite, and retained austenite may differ between the surface side and the inner side. If the steel material is tempered in this state, the hardness will not be the same on the surface side and the inner side.

Furthermore, in the case where a mold is produced from such a steel material (cut out by machining), the inside of the steel material is exposed as the surface of the mold, so that the hardness of the cut out mold surface (inner side of the PH steel material) differs from the hardness of the surface of the steel material.

The difference in hardness is a difference in steel material properties, and as described above, the difference in hardness between the surface side and the inner side of the PH steel material is an important factor in ensuring mold performance. It is preferable that the difference in hardness between the surface side and the inner side is small, and this state is evaluated as "good hardness homogeneity". In the present invention, since the content of Cr and the content of Mn are optimized, good hardness homogeneity is exhibited.

[5.4. Softening Resistance]

The temperature of the surface of the die-casting mold rises due to contact with the molten metal. In the case where the number of casting shots is increased, an accumulated time of exposure to a high temperature is also increased, and thus hardness of the surface of the mold may be decreased. Such softening causes a decrease in a high-temperature strength, and as a result, the heat check resistance is deteriorated.

For the above reasons, the die-casting mold is required to be less likely to be soften, that is, to have a "high softening resistance", in addition to the above three properties. However, it is necessary to pay attention to the matter that a steel material whose softening resistance is improved by decreasing the content of Cr has a low high-temperature strength. This is because a low-Cr steel is poor in solid-solution strengthening at a high temperature. The decrease in the high-temperature strength deteriorates heat check resistance. That is, the "good softening resistance" and the "good heat check resistance" are opposite to each other.

On the other hand, the steel material according to the present invention has optimized contents of Cr and Mn. Therefore, the steel material according to the present invention exhibits good softening resistance without significantly impairing hardenability and heat check resistance.

EXAMPLES

[1. Verification Test for Suitable Element Contents]

[1.1. Overview]

Hereinafter, items to be achieved in the present invention are described again.

(1) Machinability (2) Impact value in the case where hardening rate is low (a) few coarse foreign matters (b) few carbides and carbonitrides distributed in dot array (hereinafter also collectively referred to as "grain boundary carbides")

(c) High hardenability (3) Hardness homogeneity

In the following verification tests, the items other than (2)(a) were targeted. There are three reasons.

The first reason is that (2)(a) can be accurately verified only with a steel material produced from an ingot with an industrial size (the mass of 8 ton or more) having a low solidification rate.

The second reason is that in the case where a large steel material is actually produced by using an ingot of 8 ton or more, a cost and an examination time are excessive.

The third reason is that since influence of (2)(a) is very large, the influence of (2)(a) needs to be excluded in order to accurately verify influence of (2)(b) or (2)(c) on the impact value.

Therefore, a steel material having a small cross section (nearly diameter: 82 mm×length: 3000 mm) was produced from an ingot having a high solidification rate (a small ingot having a mass of 150 kg). Next, a test piece produced from the steel material was subjected to a heat treatment simulating an industrial production method (that is, a method for producing a large mold steel material and a large mold). In this way, it is considered that properties "other than (2)(a)" when a mold is produced from an ingot having an industrial size can be appropriately evaluated with the steel material.

On the other hand, (2)(a) was evaluated with a steel material actually produced from an ingot (an ingot having a mass of 8 ton or more) having an industrial size and having a low solidification rate.

[1.2. Verification Test of Upper Limit of Content of C]

[1.2.1. Production of Sample]

[A. Production of Round Bar]

Hereinafter, a decrease in impact value in the case where the content of C exceeded 0.31 mass % was verified.

Components (mass %) of a steel material were set to 1.20 Si—0.06 Cu—0.11 Ni—1.31 Mn—5.89 Cr—1.68 Mo—0.019 Al—0.027 N—0.18 V, and the content of C was systematically changed. These types of steels were cast into an ingot of 150 kg. After the ingot was produced, a homogenization heat treatment, hot working, normalizing, and tempering were performed.

Note that in this verification, normalizing and tempering were performed, but these treatments may be omitted. Although it was not performed in this verification, spheroidizing annealing (SA) may be performed after hot working or tempering. Through the above steps, a steel material (a round bar) in a tempered state of nearly diameter: 82 mm×length: 3000 mm was produced.

[B. Heat Treatment of Square Bar Simulating Hot Working]

Ten square bars of 12 mm×12 mm×55 mm were produced from the round bar in the tempered state.

The obtained square bar was heated to reproduce an austenite crystal grain size during industrial hot working. That is, the square bar was held in vacuum at 1240° C. for 2 H. In an industrial step, the heat treatment is not necessarily performed in vacuum, but a purpose of the verification was to simulate a temperature history, so that the heat treatment was performed in vacuum.

Next, the square bar was subjected to a heat treatment simulating cooling after performing hot working on an ingot to obtain a steel material having a large size. That is, following the holding at 1240° C. for 2 H, the square bar was cooled to 1000° C. at 1° C./min, and then cooled from 1000° C. to 600° C. at 0.5° C./min.

Note that depending on the components, carbides and carbonitrides may precipitate in a dot array at austenite grain boundaries in this temperature range.

In the temperature range of 600° C. or lower, an inert gas was introduced into a vacuum furnace to pressurize to 3 Torr to 4 Torr (0.40 kPa to 0.53 kPa), and further, forced convection of the inert gas was performed to rapidly cool the square bar.

The cooling rate at 600° C. or lower does not simulate an industrially produced steel material having a large size. However, since a purpose of this evaluation is to examine the "influence of grain boundary carbides precipitated at grain boundaries in a high temperature range after hot working", the purpose can be achieved even in the case where the cooling history at 600° C. or lower is a history as described above. The grain boundary carbide is not eliminated even by "normalizing-tempering-hardening and tempering" after the hot working, and finally remains in the mold to greatly decrease the impact value.

[C. Normalizing, Tempering, and Hardening and Tempering of Square Bars]

Next, the square bar subjected to the heat treatment simulating the hot working was subjected to normalizing and tempering in vacuum in accordance with an industrial production method.

Further, the square bar in a tempered state was vacuum-hardened. That is, the square bar was held at 920° C. for 1 H in vacuum. Next, the inert gas was introduced into the vacuum furnace to pressurize to 3 Torr to 4 Torr (0.40 kPa to 0.53 kPa), and further, forced convection of the inert gas was performed to rapidly cool the square bar to 200° C. or lower.

The cooling time for cooling from 920° C. to 200° C. during the hardening was within 60 min. That is, the cooling of the square bar is different from cooling of an industrially produced steel material having a large size. However, since the purpose of this evaluation is to examine the "influence of grain boundary carbides precipitated at grain boundaries in a high temperature range after hot working", the purpose can be achieved even in the case where the hardening is rapid cooling.

Subsequently, the square bar after the hardening was further tempered. The tempering was performed by holding the square bar at 560° C. to 600° C. for 2 H, followed by cooling to 200° C. or lower.

Further, tempering was additionally performed. That is, the above square bar was held at 560° C. to 600° C. for a predetermined time, and then cooled to 200° C. or lower. This treatment was performed once or more to refine the square bar to 39.5 HRC to 40.5 HRC. The temperature and time of the holding, and the number of treatments were changed according to the type of the steel (the content of C). This is because softening resistance varies depending on the content of C.

[1.2.2. Test Method]

An impact test piece was produced from the square bar refined to 39.5 HRC to 40.5 HRC. The impact test piece had a shape (10 mm×10 mm×50 mm, an arc radius of a notch tip: 1 mm, a notch depth: 2 mm, a cross-sectional area of the test piece at a lower portion of a notch bottom: 0.8 $cm^2$) in accordance with JIS Z2242. An impact test was performed at 15° C. to 35° C. by using the obtained impact test piece.

An impact value was used for evaluation. The impact value [$J/cm^2$] referred to here is a value obtained by dividing an absorption energy [J] by the cross-sectional area of 0.8 $cm^2$ at the lower portion of the notch bottom of the test piece, and refers to an average value of ten test pieces.

[1.2.3. Result]

An impact value required for a die-casting mold is 20 $J/cm^2$ or more for a mold with a small load and 25 $J/cm^2$ or more for a mold with a large load. In a die-casting mold having an impact value of 30 $J/cm^2$ or more, a risk of fracture is considerably reduced.

In this evaluation, the hardening is rapid cooling, but in the case where the hardening is slow cooling in an actual large mold, the impact value will be decreased by about 5 $J/cm^2$. Therefore, here, a threshold value of the impact value for quality determination was set to 25 $J/cm^2$.

FIG. 1 shows a relation between the content of C and the impact value. Unlike a large mold, in the impact test piece used in the test, the hardening is rapid cooling. Nevertheless, in the case where the content of C was excessive, some test pieces had an impact value of less than 20 $J/cm^2$. Accordingly, it can be seen that the influence of the grain boundary carbides precipitated in a high temperature range after hot working is very large. From FIG. 1, it can be seen that an impact value of 25 $J/cm^2$ or more is achieved by a type of a steel having the content of C of 0.31 mass % or less.

[1.3. Verification Test of Upper Limit of Content of V]

[1.3.1. Preparation of Square Bar]

Hereinafter, a decrease in an impact value in the case where the content of V exceeded 0.180 mass % was verified.

Components (mass %) of a steel material were set to 0.31 C—1.36 Si—0.04 Cu—0.13 Ni—1.22 Mn—5.96 Cr—1.38 Mo—0.018 Al—0.032 N, and the content of V was systematically changed. These types of steels were cast into an ingot of 150 kg. In the same manner as in the verification test of the content of C, ten square bars were produced.

[1.3.2. Test Method]

The impact value was measured in the same manner as in the verification test of the content of C.

[1.3.3. Result]

Figure 2:
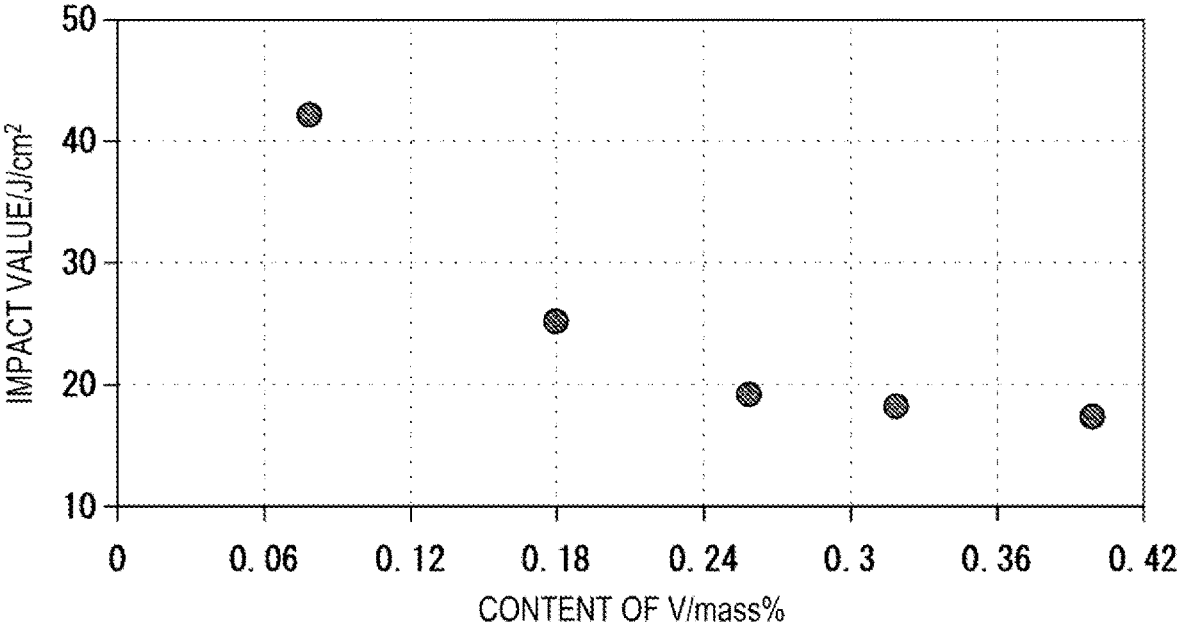
FIG. 2 is a graph showing a relation between the content of V and impact value.

FIG. 2 shows a relationship between the content of V and the impact value. Unlike a large mold, in the impact test piece used in the test, the hardening is rapid cooling. Nevertheless, in the case where the content of V was excessive, some test pieces had an impact value of less than 20 J/cm$^2$. Accordingly, it can be seen that the influence of the grain boundary carbides precipitated in a high temperature range after hot working is very large. From FIG. 2, it can be seen that an impact value of 25 J/cm$^2$ or more is achieved by a type of a steel having the content of V of 0.180 mass % or less.

[1.3.4. Suitable Ranges of Content of C and Content of V]

Figure 3:
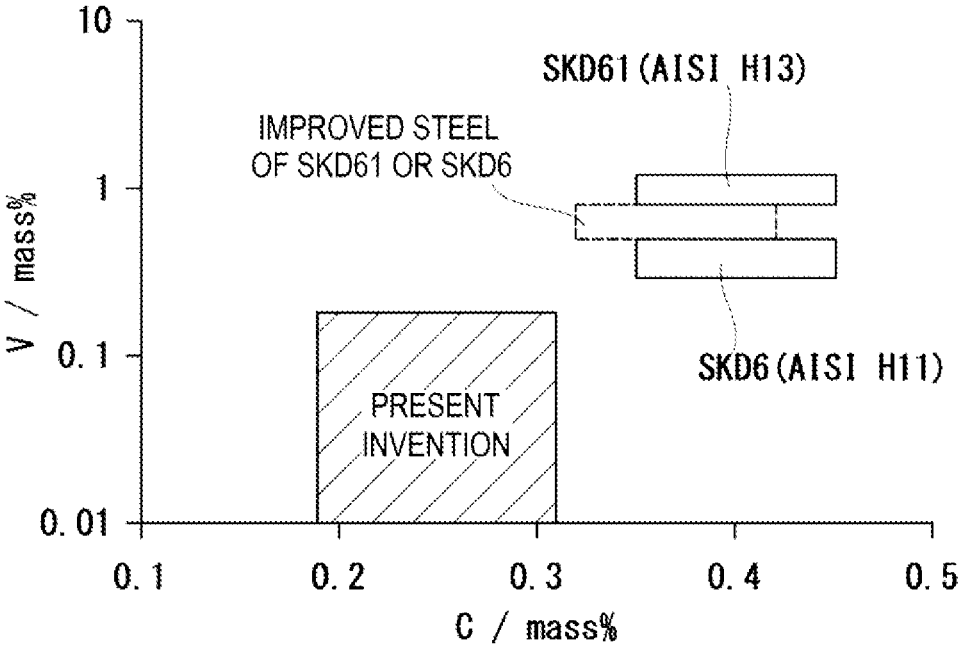
FIG. 3 is a graph showing ranges of the content of C and the content of V.

FIG. 3 shows ranges of the content of C and the content of V. In the present invention, the content of C and the content of V were defined in consideration of the "hardness", the "amount of coarse foreign matters", the "amount of grain boundary carbides precipitated at grain boundaries after hot working", and the "amount of pinning particles". A hot working die steel in the related art has the content of C of 0.32 mass % or more and the content of V of 0.30 mass % or more. On the other hand, the steel material according to the present invention has the content of C of 0.31 mass % or less and the content of V of 0.180 mass % or less, so that ranges of the content of C and the content of V are different from those of the steel in the related art.

The present invention is also different from the steel in the related art in terms of the hardening temperature. The hardening temperature of the steel in the related art is as high as 1010° C. to 1040° C. in order to sufficiently dissolve C and V. On the other hand, the hardening temperature of the present invention, which contains less C and V, may be as low as 880° C. to 980° C.

Therefore, the steel material according to the present invention has the following advantages: (a) $CO_2$ emissions can be reduced, and (b) deformation of the hardened steel material is small and cracks are less likely to occur in the steel material.

[1.4. Verification Test of Content of Mn and Content of Cr]

[1.4.1. Production of Sample]

Hereinafter, influence of the content of Mn and the content of Cr on the hardenability and the impact value was verified.

Components (mass %) of a steel material were set to 0.25 C—0.81 Si—0.08 Cu—0.09 Ni—1.78 Mo—0.05 V—0.028 Al—0.011 N, and the content of Mn and the content of Cr were systematically changed. These types of steels were cast into an ingot of 150 kg. Hereinafter, in the same manner as in the verification test of the content of C, ten square rods of 12 mm×12 mm×55 mm and one small piece of 12 mm×12 mm×20 mm were produced.

The square bars and the small piece were held in vacuum at 920° C. for 1 H and then hardened. The cooling rates during the hardening were 8° C./min from 920° C. to 750° C., 5° C./min from 750° C. to 500° C., and 0.5° C./min from 500° C. to 200° C., and the cooling rate for cooling from 200° C. to 100° C. or lower was not particularly controlled.

The above hardening step is one example assuming an inside having a lowest cooling rate in the case where a large steel material of 3000 kg or more is hardened. Since phase transformation was substantially completed when the temperature reached 200° C., the cooling rate from the state to 100° C. or lower was not particularly controlled.

Subsequently, the square bars and the small piece were tempered. The tempering was performed by holding the square bars and the small piece at 560° C. for 2 H and then cooling to 200° C. or lower.

Further, tempering was additionally performed. That is, the above square bars and the small piece were held at 560° C. to 600° C. for a predetermined time, and then cooled to 200° C. or lower. This treatment was performed once or more to refine the square bars and the small piece to 39.5 HRC to 40.5 HRC. The temperature and time of the holding, and the number of treatments were changed according to the type of the steel (the content of Mn and the content of Cr). This is because softening resistance varies depending on the content of Mn and/or the content of Cr.

[1.4.2. Test Method]

[A. Impact Test]

An impact test piece was produced from the square bar refined to 39.5 HRC to 40.5 HRC. The impact test piece had a shape (10 mm×10 mm×50 mm, an arc radius of a notch tip: 1 mm, a notch depth: 2 mm, a cross-sectional area of the test piece at a lower portion of a notch bottom: 0.8 cm$^2$) in accordance with JIS Z2242. An impact test was performed at 15° C. to 35° C. by using the obtained impact test piece.

An impact value was used for evaluation. The impact value [J/cm$^2$] referred to here is a value obtained by dividing an absorption energy [J] by the cross-sectional area of 0.8 cm$^2$ at the lower portion of the notch bottom of the test piece, and refers to an average value of ten test pieces.

[B. Softening Resistance]

Softening resistance was evaluated by using a small piece refined to 39.5 HRC to 40.5 HRC. The refined small piece was held at 560° C. for 24 H and then cooled to room temperature. Then, HRC hardness was measured at room temperature.

[1.4.3. Result]

[A. Impact Test]

Figure 4:
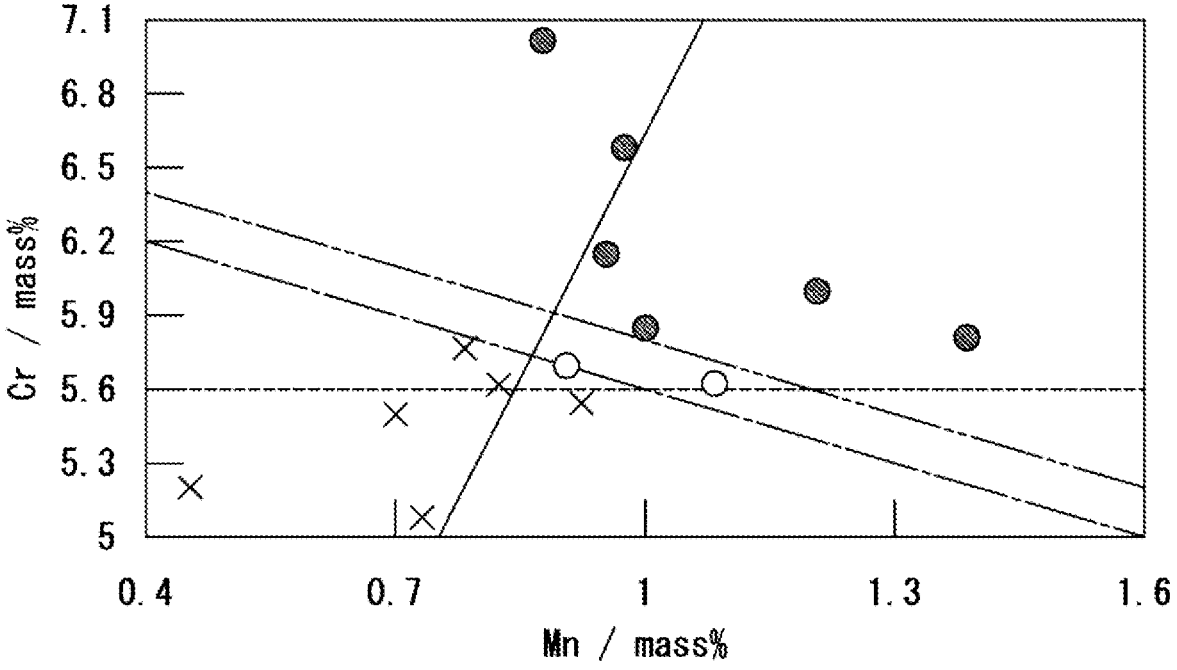
FIG. 4 is a graph showing an influence of the content of Mn and the content of Cr on impact value in the case where a hardening rate is low.

FIG. 4 shows influence of the content of Mn and the content of Cr on the impact value in the case where the hardening rate is low. In FIG. 4, "X" represents that the impact value is less than 25 J/cm$^2$, "○" represents that the impact value is 25 J/cm$^2$ or more and less than 30 J/cm$^2$, and "●" represents that the impact value is 30 J/cm$^2$ or more. The solid line represents the correlation line of Mn/Cr=0.150, and the broken line represents the correlation line of Cr=5.60 mass %. Moreover, the one-dot chain line represents the correlation line of Mn+Cr=6.60 mass %, and the two-dot chain line represents the correlation line of Mn+Cr=6.80 mass %.

From FIG. 4, it can be seen that (a) when Mn/Cr>0.15 and Cr≥5.60 mass %, the impact value becomes 25 J/cm$^2$ or more, (b) when Mn+Cr≥6.60 mass %, the impact value becomes high, and c) when Mn+Cr≥6.80 mass %, the impact value becomes stable at a higher level.

From the above, it was confirmed that the steel material according to the present invention has high hardenability under conditions where the influence of coarse foreign matters and grain boundary carbides is minimal.

[B. Softening Resistance]

Figure 5:
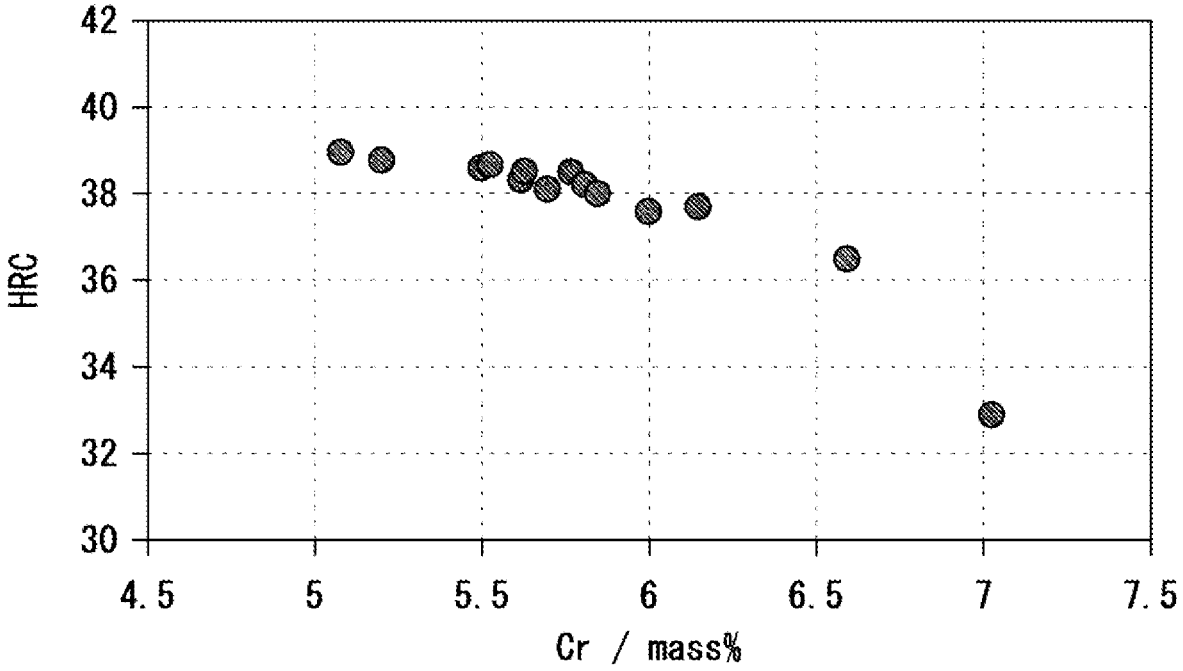
FIG. 5 is a graph showing an influence of Cr on softening resistance.

FIG. 5 shows influence of Cr on softening resistance. The smaller the decrease in hardness after heat treatment with respect to the initial hardness of 40 HRC, the higher the softening resistance. From FIG. 5, it can be seen that in the case where the content of Cr exceeds 6.60 mass %, the softening resistance deteriorates significantly.

[1.4.4. Suitable Ranges of Content of Mn and Content of Cr]

Figure 6:
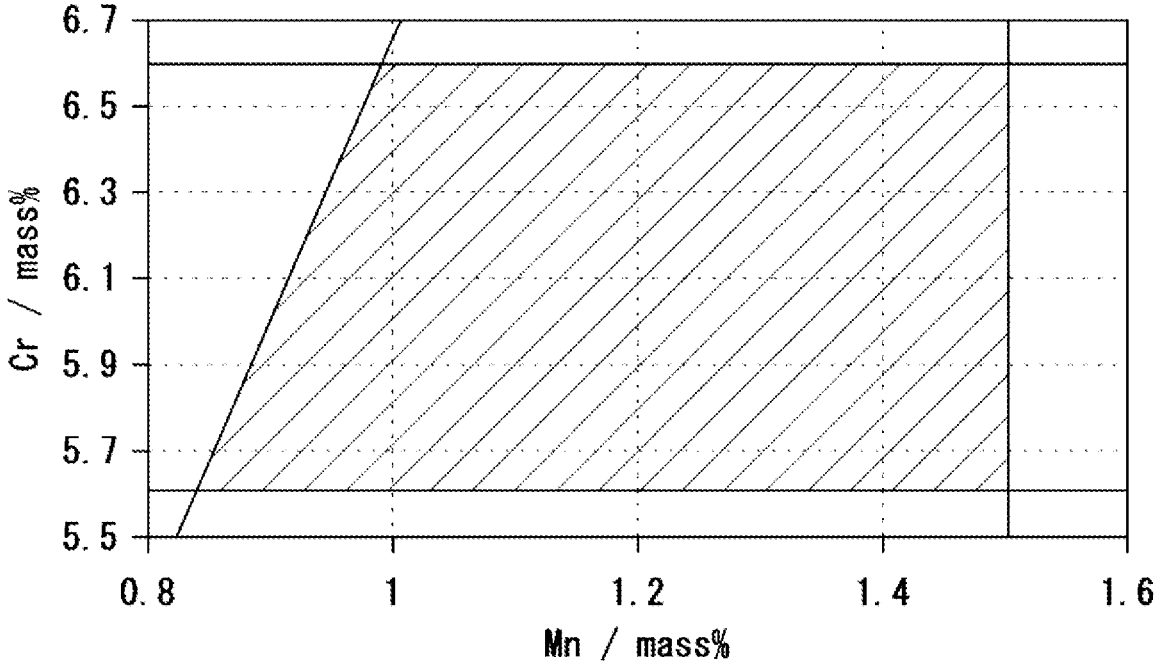
FIG. 6 is a graph showing ranges of the content of Mn and the content of Cr.

From the above, suitable ranges of the content of Mn and the content of Cr were determined. FIG. 6 shows the ranges of the content of Mn and the content of Cr. The region surrounded by four lines in FIG. 6 is a range of the steel material according to the present invention.

The ranges of the content of Mn and the content of Cr of a hot working die steel in the related art is Mn<0.80 mass % and Cr<5.80 mass %. This range is in a region off to lower left of the range shown in FIG. 6. It is clear from FIG. 6 and FIG. 3 that the composition of the steel material according to the present invention is completely different from that of a hot working die steel in the related art.

[1.5. Verification Test of Lower Limit of Content of Si]

[1.5.1. Production of Test Piece]

Hereinafter, influence of the content of Si on machinability was verified. Components (mass %) of a steel material were set to 0.22 C—1.09 Mn—0.07 Cu—0.18 Ni—6.12 Cr—1.01 Mo—0.04 V—0.023 Al—0.016 N, and the content of Si was systematically changed. These types of steels were cast into an ingot of 150 kg.

Thereafter, in the same manner as in the verification test of the content of C, a steel material (a round bar) in a tempered state of nearly diameter: 82 mm×length: 3000 mm was produced.

Next, from the round bar in the tempered state, a block of 50 mm×25 mm×200 mm was cut out. Next, the block was hardened and tempered under the same conditions as in the verification test of the content of Mn and the content of Cr, to refine the block to 39.5 HRC to 40.5 HRC.

[1.5.2. Test Method]

The block was cut with a cutting tool, and the wear amount of the cutting tool was measured. A cutting distance at which the wear amount of the cutting tool reached 300 μm was defined as a tool life. It is determined that the longer the cutting distance, the better the machinability.

[1.5.3. Result]

Figure 7:
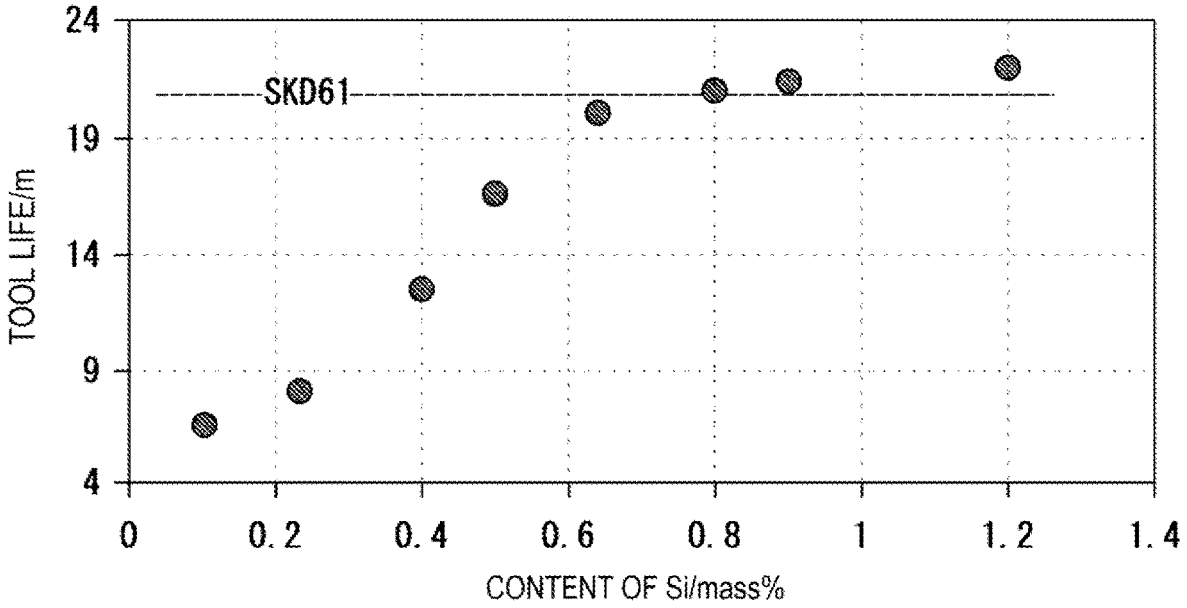
FIG. 7 is a graph showing an influence of the content of Si on machinability.

FIG. 7 shows the influence of the content of Si on the machinability. In the case where the content of Si is small, the machinability is poor and the number of steps of cutting work is enormous. Especially, since the cutting amount is large in a large mold, it is difficult to be industrially viable if machinability is poor. From FIG. 7, it can be seen that in the case where the content of Si becomes 0.40 mass % or more, the machinability improves significantly. In addition, it can be seen that in the case where the content of Si is 0.60 mass % or more, machinability close to that of SKD61, which is evaluated as having "very good machinability", can be obtained. It can also be seen that even in the case where the content of Si is further increased, the machinability approaches saturation.

[1.6. Verification Test of Lower Limit and Upper Limit of Content of Mo]

[1.6.1. Production of Test Piece]

Hereinafter, influence of the content of Mo on softening resistance was verified.

Components (mass %) of a steel material were set to 0.29 C—0.70 Si—1.39 Mn—0.07 Cu—0.12 Ni—5.79 Cr—0.03 V—0.026 Al—0.010 N, and the content of Mo was systematically changed. These types of steels were cast into an ingot of 150 kg. Thereafter, in the same manner as in the verification test of the content of C, a steel material (a round bar) in a tempered state of nearly diameter: 82 mm×length: 3000 mm was produced.

Next, from the round bar in the tempered state, a small piece of 12 mm×12 mm×20 mm was cut out. Next, the small piece was hardened and tempered under the same conditions as in the verification test of the content of Mn and the content of Cr to refine the small piece to 39.5 HRC to 40.5 HRC.

[1.6.2. Test Method]

Softening resistance was evaluated by using a small piece refined to 39.5 HRC to 40.5 HRC. The refined small piece was held at 560° C. for 24 H and then cooled to room temperature. Then, HRC hardness was measured at room temperature.

[1.6.3. Result]

Figure 8:
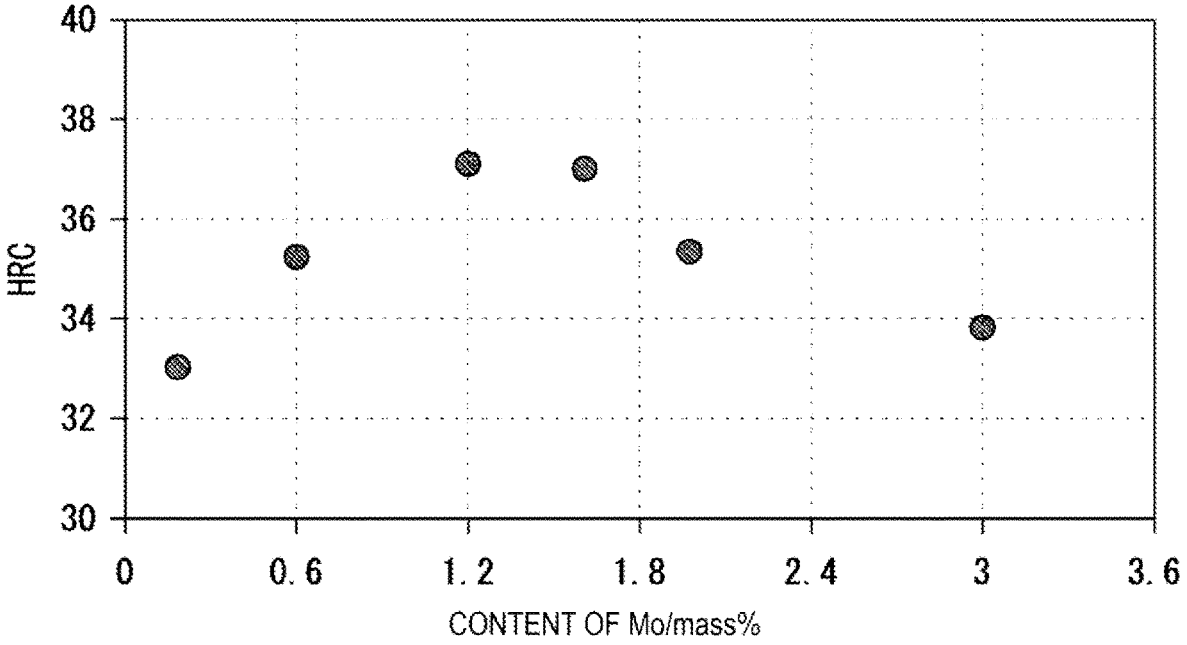
FIG. 8 is a graph showing an influence of Mo on softening resistance.

FIG. 8 shows influence of Mo on softening resistance. Both in the case where the content of Mo was too small and in the case of too large, the softening resistance decreased. Hardness of a mold produced in the PH process is often 35 HRC or higher. From FIG. 8, it can be seen that in order to ensure hardness of 35 HRC or more even after heat treatment at 560° C. for 24 H, the content of Mo needs to be 0.60 mass % or more and 2.00 mass % or less.

[2. Verification Test Using Large Ingot]

[2.1. Overview]

In the verification tests for the suitable elemental contents, a small-sized (150 kg) ingot for research was used to produce steel materials having a small cross section, and test pieces produced from the steel material was subjected to heat treatments simulating the industrial production method (the method for producing a steel material for a large mold and a large mold). Accordingly, it was possible to appropriately evaluate the properties "other than 2(a)" in the case where the steel material was produced by the industrial production method and turned into a mold.

On the other hand, in the following Examples, effects of the present invention were confirmed by actually using an ingot having a mass of 8 ton or more. In this case, a steel material was hardened and tempered, and an internal impact value was verified. That is, the above "2(a)" was verified. This is because verification of the other properties has been completed in the verification tests for the suitable elemental contents.

[2.2. Production of Sample]

[2.2.1. Production of Block Material]

Table 1 shows compositions of steels (Examples 1 to 13 and Comparative Examples 1 to 3) whose properties were verified. Comparative Example 1 corresponds to JIS SKD6 (AISI H11). Comparative Example 2 corresponds to a commercially available steel in which Si—Mn—Cr of SKD6 has been adjusted, and is a steel having better hardenability and heat check resistance than SKD6. Comparative Example 3 is a steel in which the content of C and the content of V exceed the upper limits of those of the present invention. Although not shown in Table 1, each steel includes an impurity element such as P in a range not exceeding the above-described upper limit.

TABLE 1

| | Composition (mass %) | | | | | | |
|---|---|---|---|---|---|---|---|
| | C | Si | Mn | Cu | Ni | Cr | Mo |
| Ex. 1 | 0.24 | 0.54 | 1.24 | 0.08 | 0.15 | 5.93 | 1.11 |
| Ex. 2 | 0.21 | 0.61 | 1.38 | 0.05 | 0.07 | 5.99 | 1.78 |
| Ex. 3 | 0.29 | 0.73 | 1.13 | 0.19 | 0.64 | 6.10 | 0.60 |
| Ex. 4 | 0.27 | 1.36 | 1.01 | 0.36 | 0.33 | 6.21 | 1.97 |
| Ex. 5 | 0.19 | 0.41 | 0.94 | 0.23 | 0.55 | 5.88 | 0.85 |
| Ex. 6 | 0.23 | 0.81 | 0.96 | 0.23 | 0.49 | 5.70 | 1.51 |
| Ex. 7 | 0.25 | 1.20 | 1.03 | 0.02 | 0.24 | 6.40 | 0.82 |
| Ex. 8 | 0.27 | 0.91 | 1.08 | 0.18 | 0.46 | 5.86 | 1.04 |
| Ex. 9 | 0.22 | 0.98 | 1.19 | 0.14 | 0.29 | 6.27 | 1.40 |
| Ex. 10 | 0.26 | 1.10 | 1.17 | 0.16 | 0.15 | 5.81 | 1.74 |
| Ex. 11 | 0.23 | 0.50 | 1.34 | 0.09 | 0.39 | 6.20 | 1.90 |
| Ex. 12 | 0.29 | 0.72 | 1.26 | 0.03 | 0.03 | 6.39 | 1.23 |
| Ex. 13 | 0.21 | 0.61 | 1.37 | 0.07 | 0.11 | 5.82 | 1.58 |
| Comp. Ex. 1 | 0.39 | 0.93 | 0.42 | 0.07 | 0.12 | 5.04 | 1.20 |

TABLE 1-continued

| | | | | | | | |
|---|---|---|---|---|---|---|---|
| Comp. Ex. 2 | 0.36 | 0.51 | 0.71 | 0.06 | 0.16 | 5.52 | 1.25 |
| Comp. Ex. 3 | 0.38 | 1.02 | 1.03 | 0.05 | 0.13 | 6.21 | 1.21 |

| | Composition (mass %) | | | | | |
|---|---|---|---|---|---|---|
| | V | Al | N | Mn/Cr | Cu + Ni | Selectively added |
| Ex. 1 | 0.031 | 0.018 | 0.011 | 0.209 | 0.23 | |
| Ex. 2 | 0.060 | 0.023 | 0.004 | 0.230 | 0.12 | |
| Ex. 3 | 0.097 | 0.005 | 0.017 | 0.185 | 0.83 | |
| Ex. 4 | 0.13 | 0.071 | 0.040 | 0.163 | 0.69 | |
| Ex. 5 | 0.012 | 0.038 | 0.031 | 0.160 | 0.78 | |
| Ex. 6 | 0.17 | 0.050 | 0.023 | 0.168 | 0.72 | |
| Ex. 7 | 0.016 | 0.003 | 0.007 | 0.161 | 0.26 | 0.0021 B, 0.024 Ti |
| Ex. 8 | 0.12 | 0.014 | 0.005 | 0.184 | 0.64 | 1.53 W |
| Ex. 9 | 0.043 | 0.056 | 0.009 | 0.190 | 0.43 | 0.96 Co |
| Ex. 10 | 0.060 | 0.026 | 0.027 | 0.201 | 0.31 | 0.022 Nb |
| Ex. 11 | 0.080 | 0.032 | 0.014 | 0.216 | 0.48 | 0.044 Ti |
| Ex. 12 | 0.15 | 0.048 | 0.035 | 0.197 | 0.06 | 0.027 S |
| Ex. 13 | 0.092 | 0.040 | 0.020 | 0.235 | 0.18 | 0.0011 Ca |
| Comp. Ex. 1 | 0.43 | 0.024 | 0.010 | 0.083 | 0.19 | |
| Comp. Ex. 2 | 0.58 | 0.019 | 0.019 | 0.129 | 0.22 | |
| Comp. Ex. 3 | 0.61 | 0.026 | 0.011 | 0.166 | 0.18 | |

Each of these steels was cast into an ingot having a mass of about 21 ton. The ingot of 21 ton has a lower solidification rate than an ingot of about 10 ton, and thus the coarse foreign matters are likely to affect the impact value. Under such adverse conditions, adequacy of the content of C and the content of V was verified.

The 21 ton ingot was subjected to a homogenization heat treatment at a high temperature and for a long time and then subjected to a hot working, so as to finally obtain a block material of 740 mm×1060 mm×2440 mm (about 15 ton). The difference in mass (about 6 ton) between the ingot and the block material is the mass of the portion removed due to a quality or shape problem.

Appropriate conditions for heat treatment for the block material were set depending on the steel type. For Examples 1 to 13, hardening from 920° C. and tempering at 560° C. to 600° C. were performed. For Comparative Examples 1 to 3, after normalizing, tempering, and spheroidizing annealing, hardening from 1030° C. and tempering at 580° C. to 630° C. were performed. In this way, all 16 types of steel were adjusted to have a surface hardness of a PH state of about 40 HRC.

[2.2.2. Production of Second Material and Third Material]

A portion with a large number of coarse foreign matters is in a vicinity of a center where a solidification rate is low. Therefore, as shown in FIG. 9, the first material 12 was cut out from a vicinity of a center in the c-axis direction of the block material 10 (a=740 mm, b=1060 mm, c=2440 mm, w=about 15000 kg). Next, the second material 14 was cut out from approximately the center of the ab surface of the first material 12, and the third material 16 was cut out from the end portion of the first material 12. Note that in this experiment, d=35 mm, e=95 mm, f=135 mm, and g=50 mm were set.

[2.3. Test Method]

[2.3.1. Hardness]

A small piece of 15 mm×15 mm×35 mm was cut out from a corner portion of the second material 14 (95 mm×135 mm×35 mm). A small piece of 15 mm×15 mm×35 mm was cut out from a vicinity of a center of the third material 16 (50 mm×50 mm×35 mm). These small pieces were ground and polished, and adjusted to have a parallelism and a surface roughness that allow hardness measurement. The Rockwell C scale hardness (hardness $H_1$ at the outer periphery, hardness $H_2$ at the center portion) was measured at room temperature by using these small pieces.

[2.3.2. Impact Test]

Twenty impact test pieces of 10 mm×10 mm×55 mm were produced from the second material 14 (95 mm×135 mm×35 mm). An impact test was performed at 15° C. to 35° C. by using the obtained impact test pieces.

[2.4. Result]

[2.4.1. Hardness]

Table 2 shows ΔH, $H_1$, and $H_2$. In the case of Examples 1 to 13 and Comparative Example 3, the hardness H of the outer periphery of the block material was 36.7 HRC to 42.8 HRC, and the hardness $H_2$ of the center portion was 38.8 HRC to 43.7 HRC. The absolute value ΔH (hardness homogeneity) of the difference between $H_1$ and $H_2$ was 0.5 HRC to 3.4 HRC. That is, it was reconfirmed that in the case where Mn/Cr>0.150 and Cr≥5.60 mass %, high hardenability and high hardness homogeneity are exhibited. Since ΔH is small, it is expected that differences in properties between the outer periphery of the steel material and the center portion of the steel material are also small, and a mold produced from any part of the steel material has properties stable at a high level.

In Comparative Examples 1 and 2, the hardness $H_1$ of the outer periphery of the block material was 41.2 HRC and 41.8 HRC, respectively. The hardness $H_2$ of the center portion was 45.3 HRC and 45.5 HRC, respectively. ΔH was approximately 4 HRC.

That is, in Comparative Examples 1 and 2, since Mn/Cr≤0.150 and Cr≤5.60 mass %, the hardenability and hardness homogeneity deteriorated. Since ΔH is large, there is also a large difference in properties between the outer periphery of the steel material and the center portion of the steel material, and there is concern that the properties of a mold will vary greatly depending on which part of the steel material the mold is made from.

[2.5.2. Impact Test]

Table 2 shows the average impact value, the number of test pieces of less than 20 [J/cm$^2$], and the low-impact value ratio. In all of Examples 1 to 13, the average impact value was 30 [J/cm$^2$] or more, and the low-impact value ratio was 30% or less. In Examples 1 to 13, in addition to high hardenability, since the content of C and the content of V are small, there are few coarse foreign matters and carbides or carbonitrides distributed in a dot array. As a result, the impact value was stable at a high level even in the case where a material cut out from a vicinity of a center of a large-cross-section material having a low solidification rate was subjected to a slow hardening. However, a coarse foreign matter derived from C or V was not completely absent, and a foreign matter not containing C or V was also present, and thus a test piece having an impact value of less than 20 [J/cm$^2$] was generated at a low probability.

On the other hand, in Comparative Examples 1 to 3, the average impact value was less than 30 [J/cm$^2$], and the low-impact value ratio exceeded 30%. In Comparative Examples 1 to 3, in addition to high hardenability, since the content of C and the content of V are large, there is a large number of coarse foreign matters and carbides or carbonitrides distributed in a dot array. As a result, the impact value was decreased in the case where a material cut out from a vicinity of a center of a large-cross-section material having a low solidification rate was subjected to a slow hardening.

Comparative Example 3 is a steel in which the content of C and the content of V are increased as compared with Examples 1 to 13. Therefore, in Comparative Example 3, although the hardenability was high, there was a large number of coarse foreign matters and carbides or carbonitrides distributed in a dot array. As a result, the impact value of Comparative Example 3 was smaller than those of Examples 1 to 13. That is, in the case of a large-cross-section material, it was clear that the impact value cannot be evaluated by hardenability alone, and it was possible to confirm an importance of decreasing the content of C and the content of V.

From the results in Table 2, it is determined that large molds (having a mass of 2000 kg or more) produced from the steel materials of Examples 1 to 13 by the PH process also have higher impact values than molds produced from steels with large contents of C and V in the related art.

TABLE 2

| | Average impact value [J/cm$^2$] | Number of those less than 20 [J/cm$^2$] | Low impact value ratio [%] | ΔH | H1 | H2 |
|---|---|---|---|---|---|---|
| Ex. 1 | 35 | 2 | 10 | 1.2 | 38.9 | 40.1 |
| Ex. 2 | 36 | 2 | 10 | 0.5 | 41.2 | 41.7 |
| Ex. 3 | 37 | 1 | 5 | 1.7 | 38.4 | 40.1 |
| Ex. 4 | 34 | 1 | 5 | 2.6 | 39.3 | 41.9 |
| Ex. 5 | 33 | 2 | 10 | 2.3 | 40.6 | 42.9 |
| Ex. 6 | 30 | 3 | 15 | 3.4 | 40.3 | 43.7 |
| Ex. 7 | 34 | 3 | 15 | 2.1 | 37.6 | 39.7 |
| Ex. 8 | 33 | 3 | 15 | 3.2 | 36.7 | 39.9 |
| Ex. 9 | 32 | 2 | 10 | 0.5 | 39.6 | 40.1 |
| Ex. 10 | 30 | 5 | 25 | 1.9 | 39.3 | 41.2 |
| Ex. 11 | 32 | 4 | 20 | 1.8 | 39.1 | 40.9 |
| Ex. 12 | 38 | 1 | 5 | 0.5 | 42.8 | 43.3 |
| Ex. 13 | 33 | 5 | 25 | 0.7 | 38.1 | 38.8 |
| Comp. Ex. 1 | 18 | 15 | 75 | 4.1 | 41.2 | 45.3 |
| Comp. Ex. 2 | 19 | 11 | 55 | 3.7 | 41.8 | 45.5 |
| Comp. Ex. 3 | 26 | 9 | 45 | 1.9 | 41.3 | 43.2 |

[3. Versatility]

As described above, the verification has been performed assuming a die-casting mold, but the present invention can be applied not only to die-casting but also to molds and parts used in various types of casting. In addition to casting, the present invention can also be applied to molds and parts used for forging, hot stamping, extrusion, injection molding of resin, blow molding of resin, molding or processing of rubber or fiber-reinforced plastic, and the like. In the above verification, the steel material was hardened from 920° C., tempered at 560° C. to 600° C., and refined to about 40 HRC to evaluate the properties. But a steel material that is adjusted to a wide range of hardness by a wide range of hardening temperature and a wide range of tempering temperature depending on an application thereof, can be applied to molds and parts.

In the verification of the properties, a block material from a molten material was used, but the steel material according to the present invention may also be used as a powder, a bar material, a wire material, or a plate material.

For example, in the case where the steel material according to the present invention is used as a powder, the present invention can be applied to various sequential forming such as additive manufacturing (SLM method, LMD method, and the like) and PPW.

In the case where the steel material according to the present invention is used as a bar material from a molten material, a mold or a part can be produced from the steel material. Also, in the case where the steel material according to the present invention is used as a bar material or wire material from a molten material, the steel material can be applied to welded additive manufacturing or repair using TIG welding or laser welding.

In the case where the steel material according to the present invention is used as a plate material, a mold or a part can also be produced by joining the steel materials. Of course, a mold or a part can also be produced by joining members made of the steel material according to the present invention.

As described above, the steel material according to the present invention can be applied to members having various shapes. It is possible to produce or repair a mold or a part using various methods from materials having various shapes made of the steel material according to the present invention.

Although the embodiments of the present invention have been described in detail above, the present invention is not limited to the above embodiments, and various modifications can be made without departing from the gist of the present invention.

The present application is based on Japanese patent application No. 2022-167688 filed on Oct. 19, 2022, and the contents thereof are incorporated herein as reference.

INDUSTRIAL APPLICABILITY

The steel material according to the present invention can be used as a mold or a part thereof used in various processing such as casting, forging, hot stamping, extrusion, injection molding, and blow molding.

The invention claimed is:

1. A steel material for a pre-hardened mold, comprising:
0.19 mass %≤C≤0.31 mass %;
0.010 mass %≤V≤0.180 mass %;
Mn≤1.50 mass %;
5.60 mass %≤Cr≤6.60 mass %;
Cu+Ni≤0.84 mass %;
0.40 mass %≤Si≤1.40 mass %;
0.60 mass %≤Mo≤2.00 mass %;
0.001 mass %≤Al≤0.080 mass %; and
0.003 mass %≤N≤0.040 mass %,
with a balance being Fe and unavoidable impurities, wherein the contents of Mn and Cr satisfy Mn/Cr>0.150 and Mn+Cr≥6.80 mass %,
having a minimum dimension (Lmin) of 300 mm or more among a longitudinal dimension (L1), a lateral dimension (L2), and a height dimension (L3), and
having an average impact value of 30 J/cm$^2$ or more.

2. The steel material according to claim 1, further comprising one group or two groups or more selected from the following Groups A to G:
Group A: one kind or two kinds selected from:
0.30 mass %<W≤2.00 mass %; and
0.30 mass %<Co≤1.00 mass %,
Group B:
0.0002 mass %<B≤0.0080 mass %,
Group C: one kind or two kinds or more selected from:
0.006 mass %<S≤0.180 mass %;
0.0005 mass %<Ca≤0.0500 mass %;
0.03 mass %<Se≤0.50 mass %;
0.005 mass %<Te≤0.100 mass %;
0.01 mass %<Bi≤0.50 mass %; and
0.03 mass %<Pb≤0.50 mass %, and Group D: one kind or two kinds or more selected from:

0.004 mass %<Nb≤0.100 mass %;

0.004 mass %<Ta≤0.100 mass %;

0.004 mass %<Ti≤0.100 mass %; and 0.004 mass %<Zr≤0.100 mass %.

3. The steel material according to claim 1, having a mass of 3000 kg or more.

4. The steel material according to claim 1, having a hardness of 35 HRC or more and 45 HRC or less at a center portion.

5. The steel material according to claim 1, having an absolute value of a difference between a hardness at a center portion and a hardness at an outer periphery being 3.5 HRC or less.

6. The steel material according to claim 1, having a low-impact value ratio of 30% or less.

7. A mold, produced from the steel material described in claim 1, and having a mass of 2000 kg or more.

8. The steel material according to claim 1, wherein:

0.20 mass %≤C≤0.30 mass %; and 0.013 mass %≤V≤0.170 mass %.

9. The steel material according to claim 1, wherein 5.70 mass %≤Cr≤6.50 mass %.

10. The steel material according to claim 1, wherein the contents of Mn and Cr satisfy Mn/Cr≥0.155.

11. The steel material according to claim 1, wherein 0.50 mass %≤Si≤1.30 mass %.

12. The steel material according to claim 1, wherein 0.80 mass %≤Mo≤1.95 mass %.

13. The steel material according to claim 1, wherein Cu+Ni≤0.78 mass %.

14. The steel material according to claim 1, wherein:

0.002 mass %≤Al≤0.070 mass %; and 0.004 mass %≤N≤0.038 mass %.

15. The steel material according to claim 1, wherein the steel material is hardened at a hardening temperature of 880° C. or more and 980° C. or less.

16. The steel material according to claim 1, wherein the low-impact value ratio is 20% or less.

* * * * *